US007717650B2

(12) United States Patent
Reschke et al.

(10) Patent No.: US 7,717,650 B2
(45) Date of Patent: May 18, 2010

(54) ROOF TRUSS SHOE HAVING WEDGE RETENTION DEVICE AND METHOD OF USING THE SAME

(75) Inventors: Tony Reschke, Langley (CA); Roland Walker, Syracuse, UT (US); Raymond Brandon, Grand Junction, CO (US)

(73) Assignee: Dywidag-Systems International, U.S.A., Inc., Bolingbrook, IL (US)

( * ) Notice: Subject to any disclaimer, the term of this patent is extended or adjusted under 35 U.S.C. 154(b) by 558 days.

(21) Appl. No.: 11/548,170

(22) Filed: Oct. 10, 2006
(Under 37 CFR 1.47)

(65) Prior Publication Data

US 2007/0264090 A1 Nov. 15, 2007

Related U.S. Application Data

(63) Continuation-in-part of application No. 10/725,895, filed on Dec. 2, 2003, now Pat. No. 7,118,310.

(51) Int. Cl.
*E21D 21/00* (2006.01)

(52) U.S. Cl. ..... 405/302.1; 405/288; 405/302.2

(58) Field of Classification Search ..... 405/259.1, 405/288, 302.1, 302.2
See application file for complete search history.

(56) References Cited

U.S. PATENT DOCUMENTS

| | | | | |
|---|---|---|---|---|
| 4,630,974 | A * | 12/1986 | Sherman | 405/288 |
| 4,946,315 | A * | 8/1990 | Chugh et al. | 405/288 |
| 4,960,348 | A * | 10/1990 | Seegmiller | 405/259.1 |
| 5,466,095 | A * | 11/1995 | Scott | 405/302.2 |
| 5,544,982 | A * | 8/1996 | Seegmiller | 405/288 |
| 5,755,535 | A * | 5/1998 | Fox | 405/288 |
| 6,881,015 | B2 | 4/2005 | Wallstein et al. | |
| 6,884,005 | B1 * | 4/2005 | Seegmiller | 405/288 |
| 7,066,688 | B2 | 6/2006 | Wallstein et al. | |
| 7,118,310 | B2 | 10/2006 | Wallstein et al. | |
| 7,261,494 | B2 * | 8/2007 | Stankus et al. | 405/288 |
| 7,338,234 | B2 | 3/2008 | Rataj et al. | |
| 7,381,013 | B1 | 6/2008 | Rataj et al. | |
| 7,384,216 | B2 | 6/2008 | Wallstein et al. | |
| 7,588,394 | B1 | 9/2009 | Walker et al. | |
| 2005/0115188 | A1 | 6/2005 | Wallstein et al. | |
| 2005/0201837 | A1 * | 9/2005 | Stankus et al. | 405/288 |
| 2006/0211311 | A1 | 9/2006 | Wallstein et al. | |
| 2009/0180841 | A1 | 7/2009 | Walker et al. | |

FOREIGN PATENT DOCUMENTS

| | | |
|---|---|---|
| CA | 2 253 077 | 6/1999 |
| CA | 2 520 145 | 3/2006 |

* cited by examiner

*Primary Examiner*—Frederick L Lagman
(74) *Attorney, Agent, or Firm*—Marshall, Gerstein & Borun LLP

(57) ABSTRACT

A truss shoe for a mine roof truss comprises a base having a pair of ends, a curved side extending between the ends, a top side, and a bearing surface. The shoe includes an angled stanchion having a bore and a housing having a tapered bore, with a recess between the housing and stanchion. A retainer is sized to fit in the recess, with the retainer having an aperture disposed adjacent an end such that the blocks a portion of the opening of the bore in the housing to retain a wedge assembly in the tapered bore.

13 Claims, 21 Drawing Sheets

ROOF TRUSS SHOE HAVING WEDGE RETENTION DEVICE AND METHOD OF USING THE SAME

RELATED APPLICATIONS

This application claims priority from earlier-filed U.S. application Ser. No. 10/725,895, filed Dec. 2, 2003, now U.S. Pat. No. 7,118,310 entitled Truss Shoe for a Mine Roof and Method.

FIELD OF THE INVENTION

The present invention relates generally to mine roof trusses typically formed using a pair of inclined bar bolts, cables, and a pair of truss shoes. More particularly, the present invention relates to a truss shoe having a wedge retention device that retains the cable-gripping wedges.

BACKGROUND OF THE INVENTION

In mining operations, bolts are often used to support the roof of the mine. In some applications, a pair of spaced apart inclined bar bolts are anchored into the roof of the mine. Each inclined bar bolt is connected to a truss shoe, which is often called a truss bracket. The truss shoes, which also are spaced apart due to their connection to the inclined bar bolts, are joined together by a pair of horizontally extending members which in turn are joined by a coupler. Typically, the horizontal member consists of a pair of generally horizontally threaded rods, with each of the threaded rods being connected to a corresponding one of the truss shoes.

Certain considerations may be faced when installing a mine roof truss. For example, the inclined bar bolts are typically installed using a bolting machine, and the truss shoes typically are already attached to the inclined bar bolts. The installer than installs the horizontal rods and the coupler that extend between the truss shoes. The horizontal rods may be connected to one another using a variety of couplers, such as a spacer tube or a dog bone coupler. One end of each of the threaded rods must be secured to a corresponding one of the truss shoes. After the assembly is complete, the horizontal rods are tensioned using a tensioning machine.

Each truss shoe has a tapered bore or barrel sized to receive an end of one of the horizontal rods, and a set of wedge pieces are placed in the bore on each one of the truss shoes. These wedge pieces grip the horizontal rod such that tension on the pair of horizontal members tends to draw the wedge pieces deeper into the tapered barrel, thus tightening the grip on the horizontal member.

The installer typically must ensure that the wedge pieces in each of the truss shoes are in place and have not been knocked loose or lost during any of the assembly steps. Many times, the wedge pieces must be manually placed in the tapered portion of the bore in the truss shoe. Unfortunately, these loose wedge pieces can easily fall to the ground during installation, where these small wedge pieces may be lost in the darkness of a mine passage. Of course, valuable time and effort may be expended looking for and recovering any missing wedge pieces. Even if the installer has a ready supply of replacement wedges, the installer often must expend extra time and effort inserting new wedges, which must be accomplished in the often cold and/or dark setting of a mine.

SUMMARY OF THE INVENTION

In accordance with an aspect of the invention, a truss shoe for use in a roof truss adjacent a mine roof comprises a base having a pair of ends, a curved side extending between the ends, a top side, and a bearing surface adapted to abut the mine roof. The shoe includes an angled stanchion on the top side having a first bore extending through to the bearing surface and adapted to receive an inclined bolt of the roof truss, a housing on the top side of the shoe separated from the stanchion by a recess and including a second an preferably tapered bore having a first opening adjacent an end of the housing and a having second opening disposed adjacent the recess. A retainer is sized to fit in the recess, with the retainer having an aperture disposed adjacent an end, the end of the retainer sized to block a portion of the second opening of the second bore.

In further accordance with one or more preferred embodiments, the second bore houses a wedge assembly, and the recess is sized to permit the wedge assembly to be inserted into the second opening of the second bore through the recess. The wedge assembly includes a plurality of wedges adapted to engage a cross member of the roof truss with progressively greater force in response to movement of the wedge assembly further into the tapered portion. The end of the retainer may be arranged to prevent the plurality of wedges from exiting the second bore into the recess, and the wedge assembly may include a removable spacer plug. The end aperture of the retainer is sized to permit the spacer plug to pass between the aperture and the recess while retaining the plurality of wedges in the second bore.

The retainer may include a cylindrical first portion and a semi-cylindrical second portion, and the retainer may be formed from a generally cylindrical tube having a notch. The retainer may be sized to extend at least partially into the second bore, or an end of the retainer may be positioned adjacent the opening to the bore without actually entering the bore. The recess may have a shaped lower surface, and a lower surface of the retainer may be shaped to engage the lower surface of the recess. These surfaces may be semi-cylindrical.

In accordance with another aspect of the invention, a truss shoe comprises a base having a pair of ends, pair of sides extending between the ends, with one of the pair of sides including a curved portion, a top side, and a bearing surface adapted to abut a mine roof. An angled stanchion is carried on the top side and has a first bore extending through to the bearing surface. The stanchion and the first bore are adapted to receive an inclined support of the roof truss. The base includes a second bore having a tapered portion, the second bore extending along an axis generally parallel to a plane of the bearing surface, the second bore having a first opening adjacent one of the ends of the housing and a having second opening disposed adjacent a recess. A wedge assembly is disposed in the tapered portion of the second bore, and the recess is sized to permit the wedge assembly to be inserted into the second bore through the second opening, with the wedge assembly including a plurality of wedges adapted to engage a cross member of the roof truss with progressively greater force in response to movement of the wedge assembly further into the tapered portion. A retainer is disposed at least partially in the second bore and positioned to retain the plurality of wedges in the second bore.

In accordance with a further aspect of the invention, a method of securing a cross member of a mine roof truss system to a truss shoe comprises the steps of providing a truss shoe having an inclined bore, a generally horizontal bore, a bearing surface, and a curved side edge, placing a wedge assembly in the horizontal bore, providing a retainer adapted to engage the truss shoe to prevent the sedge assembly form exiting the horizontal bore, using the inclined bore to secure the truss shoe to an inclined support member, and using the horizontal bore to secure the truss shoe to a cross member.

Figure 1:
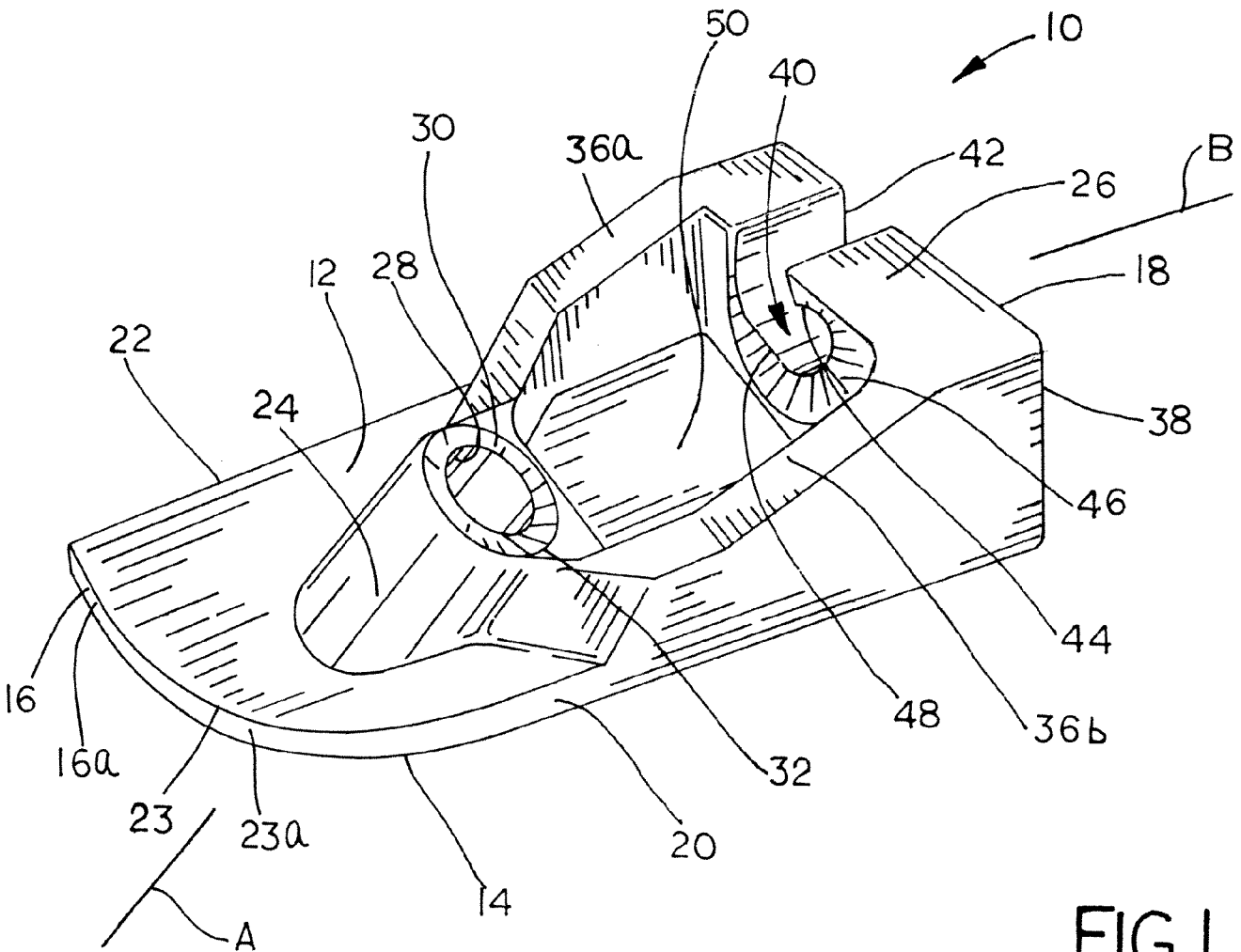
FIG. 1 is a perspective view of a truss shoe for a mine roof assembled in accordance with the teachings of a disclosed example of the present invention.

While the devices and methods described herein are susceptible to various modifications and alternative constructions, certain illustrative embodiments have been shown in the drawings and will be described below in detail. It should be understood, however, that there is no intention to limit the invention to the specific forms disclosed. On the contrary, the intention is to cover all modifications, alternative constructions, and equivalents falling within the spirit and scope of the disclosure.

DETAILED DESCRIPTION OF THE PREFERRED EMBODIMENT

The example described herein is not intended to be exhaustive or to limit the scope of the invention to the precise form or forms disclosed. Rather, the following exemplary embodiment has been chosen and described in order to best explain the principles of the invention and to enable others skilled in the art to follow the teachings thereof.

Figure 2:
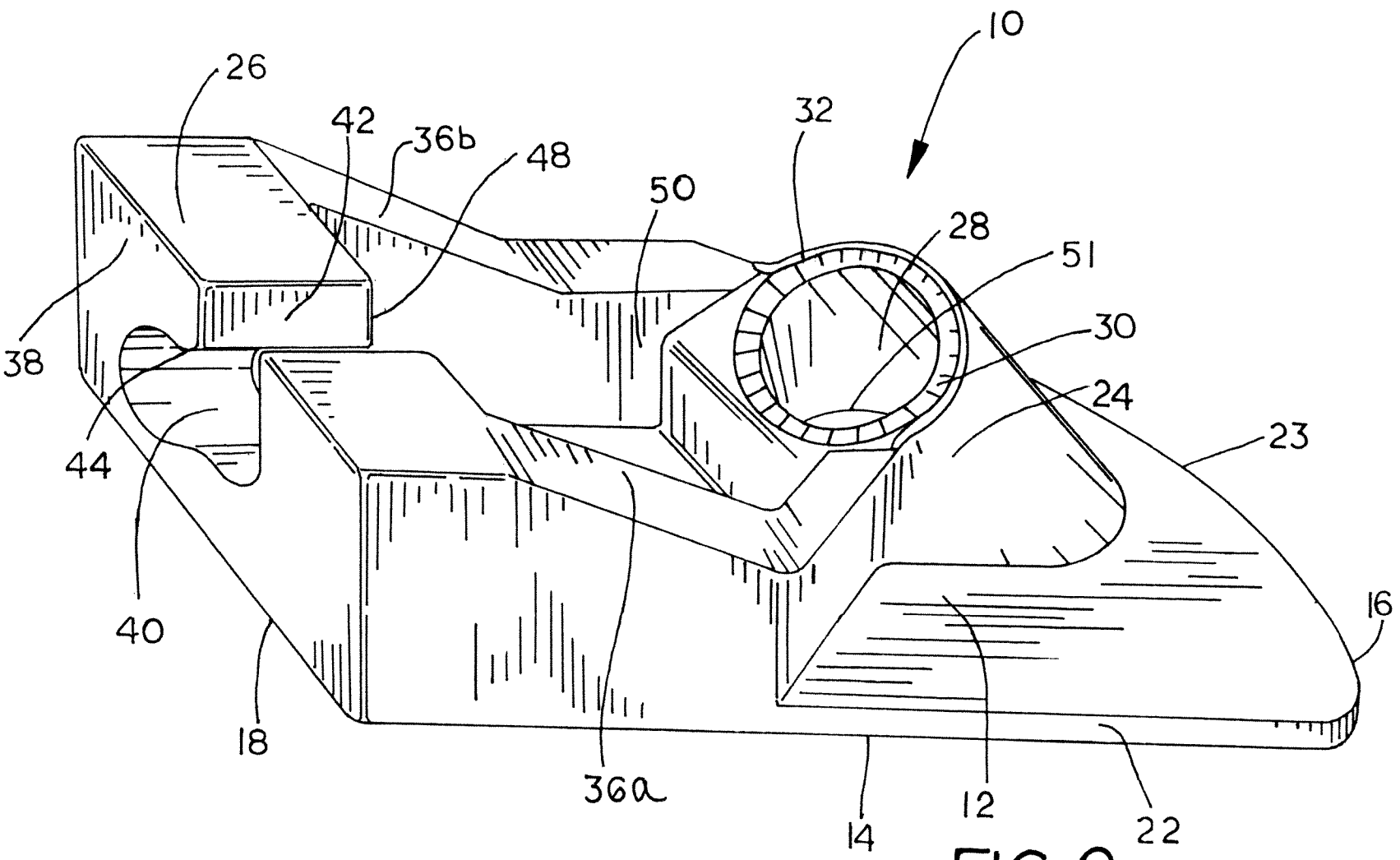
FIG. 2 is an enlarged perspective view of the truss shoe off FIG. 1 taken from the other side.
Figure 3:
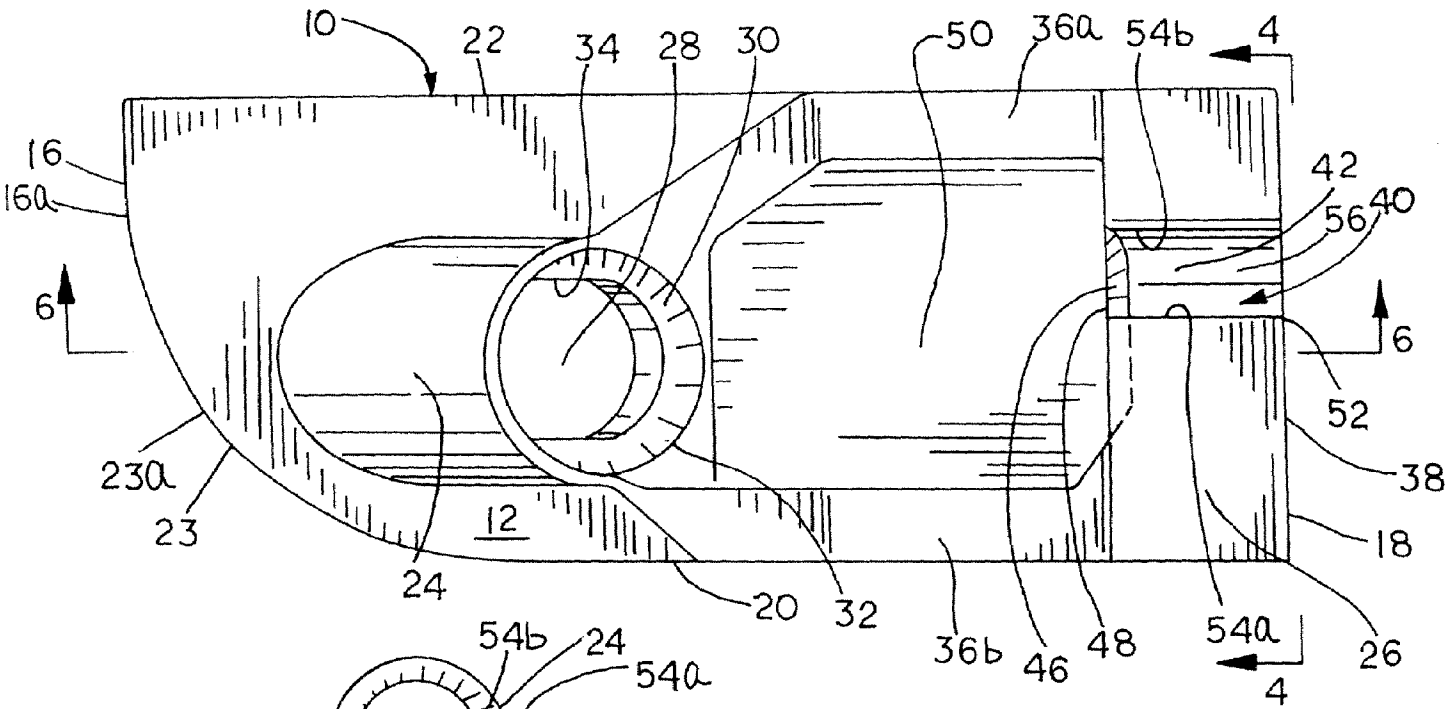
FIG. 3 is a top plan view thereof.

Referring now to FIGS. 1-3 of the drawings, a truss bracket or truss shoe assembled in accordance with the teachings of the present invention and for use in a mine roof truss is shown and is generally referred to by the reference numeral 10. The truss shoe 10 includes a top side 12, a generally planar bottom side 14, a pair of ends 16, 18, and a pair of sides 20, 22. For purposes of the following discussion, the terms "top" and "bottom" are used to refer to elements of the truss shoe 10 when the truss shoe 10 is disposed as shown in FIGS. 1-6. It will be understood that when the truss shoe 10 is used in a mine roof truss as will be explained in greater detail below and as shown in FIGS. 7-10, the bottom side 14 will face generally upward and will be in abutting contact with the roof of the mine. In the disclosed example, the end 16 and the side 20 meet along a generally curved transition 23. The end 16 includes a face or edge 16*a*, while the curved transition 23 includes a face or edge 23*a*.

A stanchion 24 and a retaining bracket 26 are formed on the top side 12 of the truss shoe 10, with the stanchion 24 including a bore 28. The bore 28 includes a seat 30 formed adjacent an upper end 32 of the bore 28, and the bore 28 extends through the bottom side 14 to form a slot 34 (best visible in FIGS. 6 and 7) formed in the bottom side 14 of the shoe 10. It will be appreciated that the stanchion 24 and hence the bore 28 are disposed at an angle relative to the generally planar bottom side 14.

Figure 4:
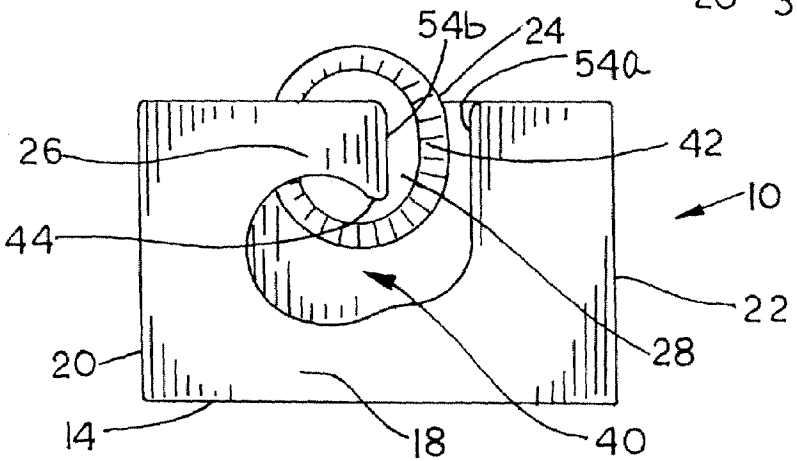
FIG. 4 is a right to side elevation all view taken along line 4-4 all of FIG. 3.

The retaining bracket 26 is formed by a pair of spaced apart walls 36*a*, 36*b* which extend generally from the stanchion toward an end wall 38. The end wall 38 includes a J-shaped bore 40. The J-shaped bore 40 includes an opening or slot 42 formed in the end wall 38. The bore 40 may also include a retaining lip 44 (FIG. 4). A recessed seat 46 is formed adjacent an inner end 48 of the bore 40. A space 50 is defined between the stanchion 24 and the end wall 38, with the space 50 bounded, at least in part, by the walls 36*a* and 36*b*.

The bore 28 includes an axis generally referred to by the reference arrow A, while the bore 40 includes an axis generally referred to by the reference arrow B. The axis A is disposed at an angle relative to a plane of the bottom side 14 of the shoe 10 and, preferably, will be disposed so as to roughly approximate the angle of an inclined roof bolt disposed in the roof of the mine as will be discussed in greater detail below. The axis B is disposed generally parallel to the plane of the bottom side 14 of the shoe 10.

Figure 5:
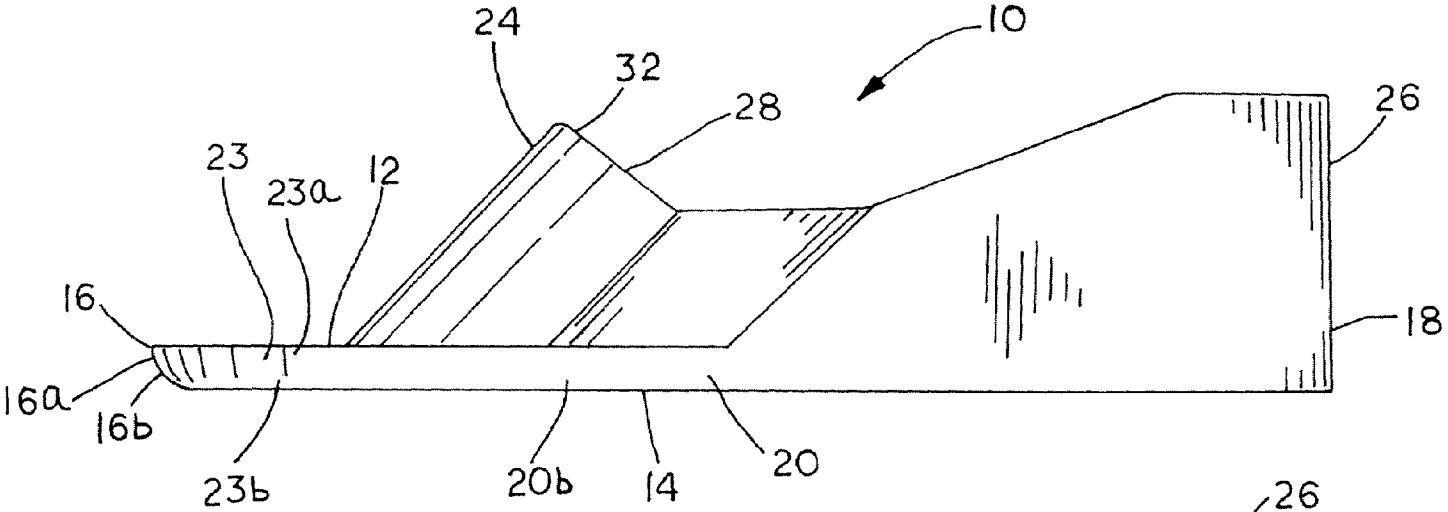
FIG. 5 is a front side elevational view of the truss shoe.
Figure 6:
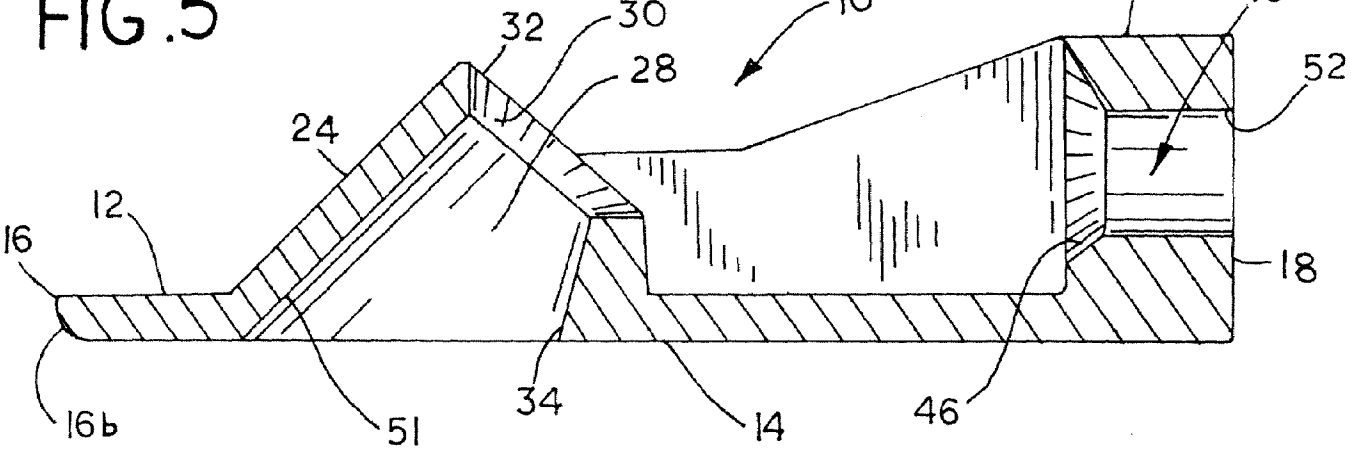
FIG. 6 is a cross-sectional view taken along line 6-6 of FIG. 3.

Referring now to FIG. 5, in the disclosed example, the edge 20*a* and the edge 23*a* both preferably include an angle or chamfer, 20*b* and 23*b*, respectively. The edge 16*a* may also include a chamfer 16*b* (FIGS. 5 and 6). As shown in FIG. 6, the seat 30 of the bore 28 is recessed relative to the upper end 32 of the bore 28. Preferably, the seat 30 will have a generally conical or a generally spherical shape. Also, the bore 28 widens and expands as the bore 28 proceeds from the upper end 32 toward a lower end 51, with the bore 28 terminating in the slot 34 (FIG. 6) formed in the bottom side 14 of the shoe 10. Referring to FIG. 6, the J-shaped bore 40 is shown toward the right side of the drawing, with the bore 40 extending from the seat 46 to an end 52. Preferably, the seat 46 will have a generally conical or a generally spherical shape.

Referring now to FIGS. 3 and 4, the slot 42 of the J-shaped bore 40 is defined, at least in part, by a pair of edges or faces 54*a*, 54*b* defined in the end wall 38 of the retaining bracket 26. The faces 54*a* and 54*b* cooperate to define a gap 56. The gap 56 is sized to receive the shank of a horizontal bolt as will be explained in greater detail below. Further, it will be understood that the gap 56 and the space 50 are sized to permit the horizontal bolt having an attached head to be mounted to the truss shoe 10 as will be explained below. Further, with it will be understood that the space 50 is sized to receive the head attached to the horizontal bolt.

Figure 7:
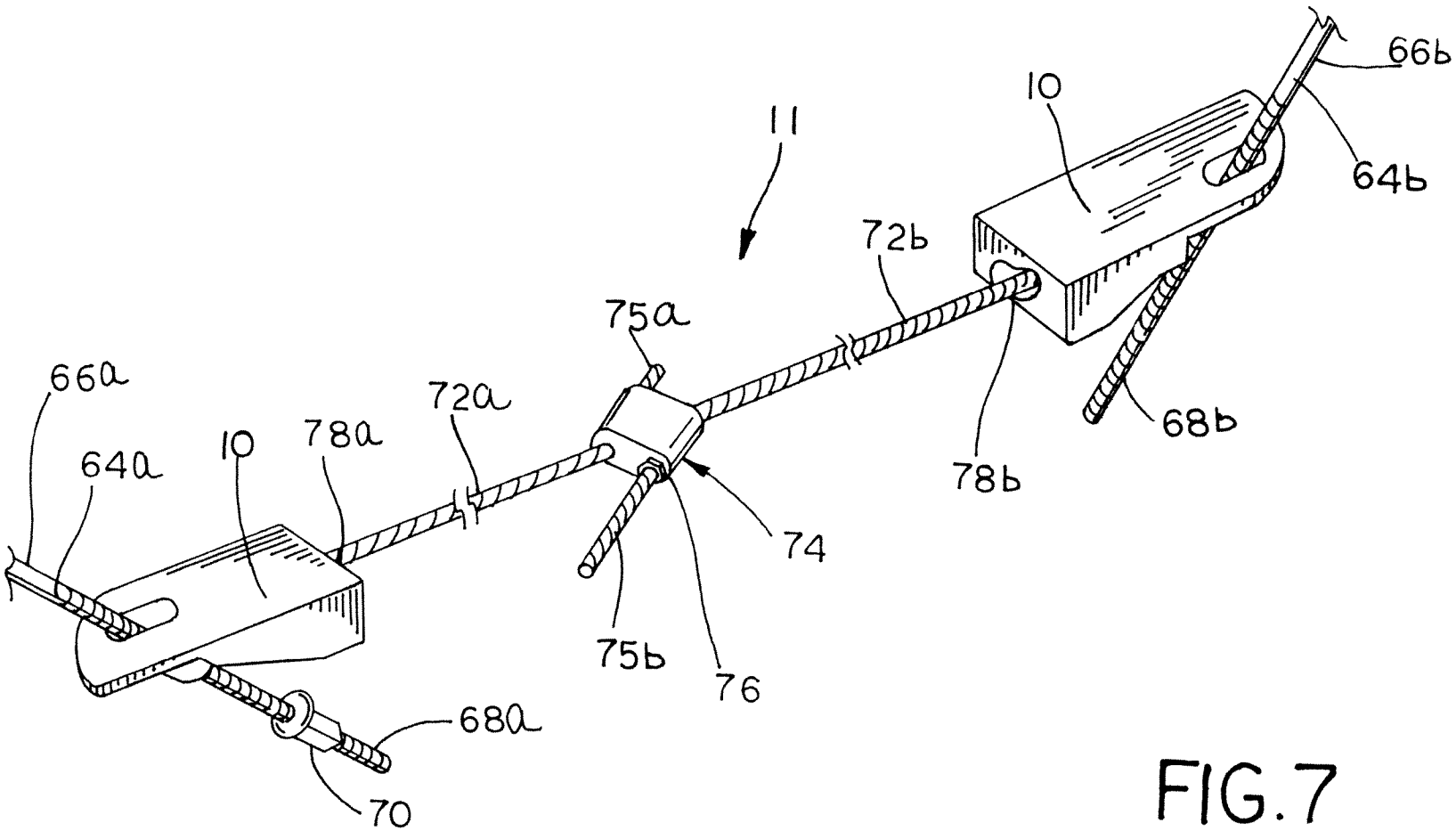
FIG. 7 is a perspective view of an assembled world to truss employing a pair of spaced apart truss shoe is assembled in accordance with the teachings of the present invention and joined apart by a central coupler.
Figure 8:
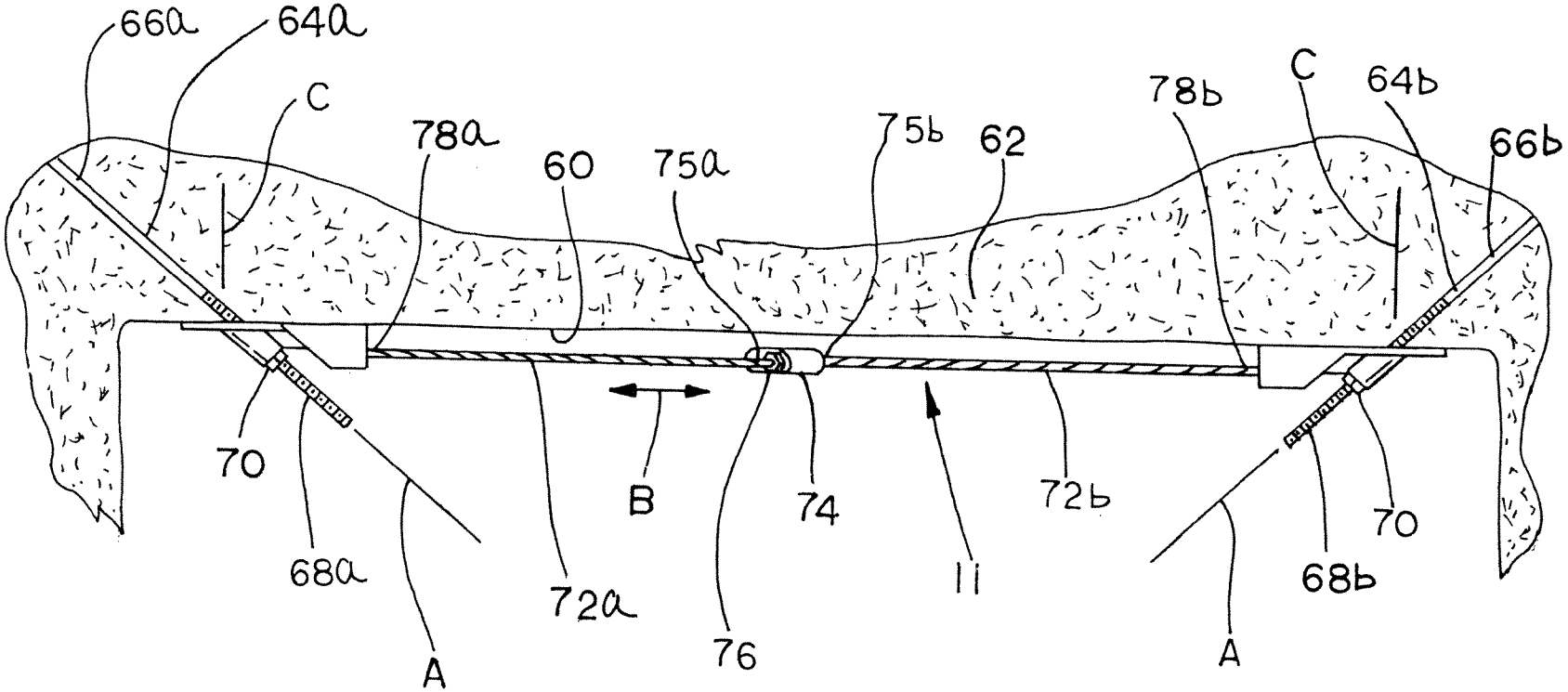
FIG. 8 is an elevation all view of a roof truss shown in place in a mine roof.
Figure 9:
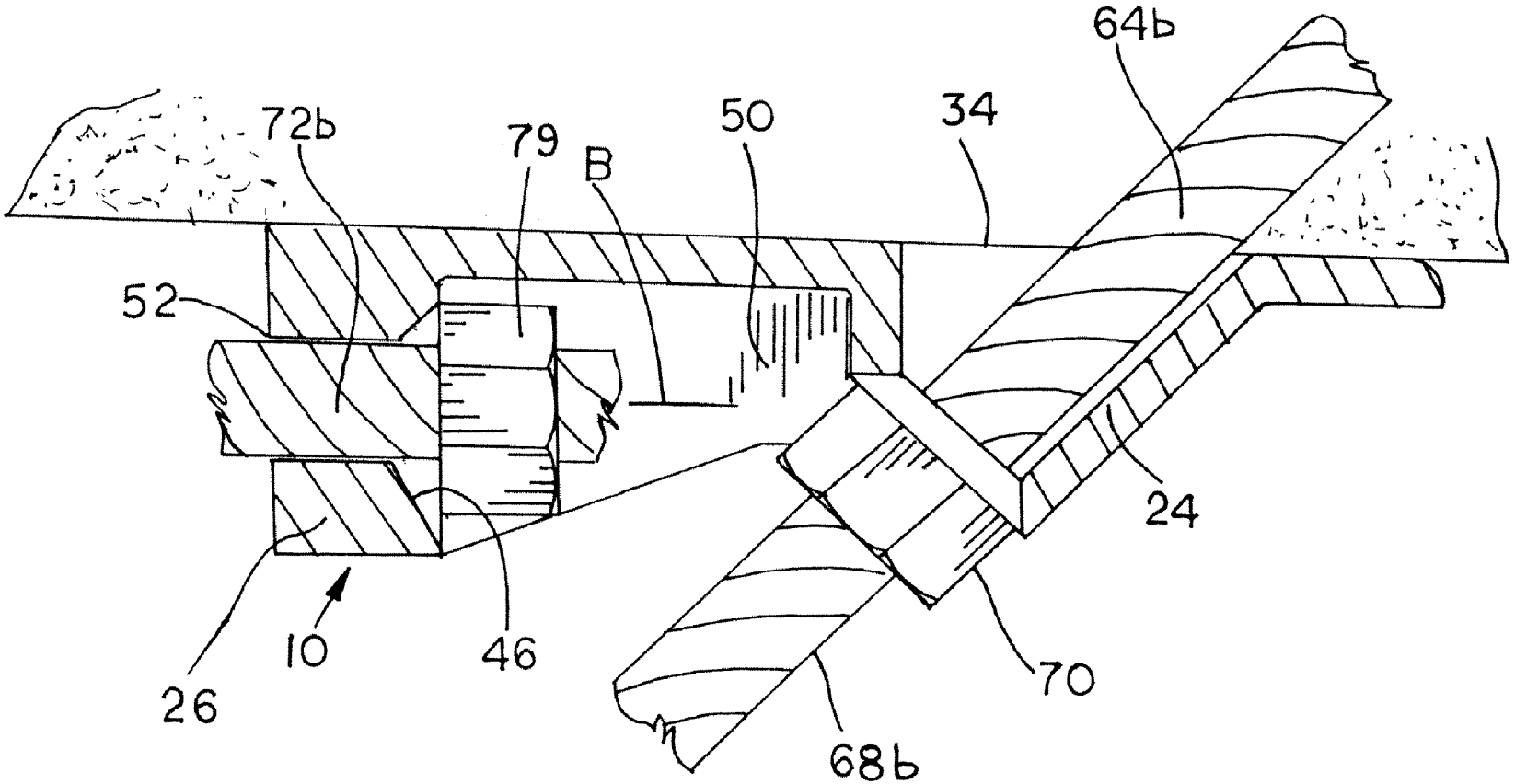
FIG. 9 is a cross-sectional view of a truss shoe shown in place in a mine roof truss.

Referring now to FIGS. 7 and 8, a pair of truss shoes 10 are shown in spaced apart arrangement and disposed generally adjacent a roof 60 of a mine 62 to form a roof truss 11. Each of the truss shoes 10 is attached to a corresponding inclined roof bolt the 64*a* and 64*b*. Each of the roof bolts may be of a conventional roof bolt of the type commonly employed in the art, with each of the roof bolts 64*a*, 64*b* including an anchored portion 66*a*, 66*b*, respectively. The anchored portions 66*a*, 66*b* of each bolt 64*a*, 64*b* may be anchored to the surrounding rock (i.e. the roof 62) using cement, epoxy resin, a mechanical expansion shell, or any other suitable means of securement. Each of the bolts 64*a*, 64*b* also includes an exposed end 68*a*, 68*b*, with each exposed end having a retaining nut 70 (FIG. 9). Preferably, each retaining nut 70 may be generally rounded or otherwise formed to correspond to the shape of the seat 30 (FIG. 6) on each of the truss shoes 10. Alternatively, the retaining nuts 70 may be provided with a washer sized to correspond to the shape of the seat 30.

Figure 10A:
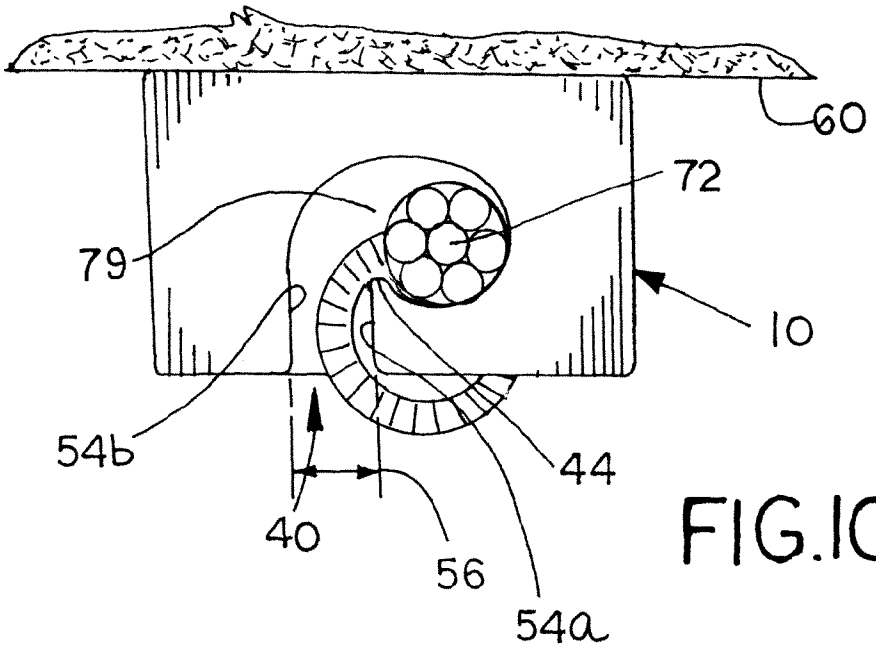
FIG. 10A is an end view of the truss shoe taken along line 10-10 of FIG. 9.

Referring to FIG. 8, a cross member 72 having a first part 72*a* and a second part 72*b* extends between the spaced apart truss shoes 10. In the disclosed example, the first and second parts 72*a* and 72*b* are joined together by a central coupler 74. Each of the first and second parts 72*a* and 72*b* is preferably threaded or otherwise constructed to receive suitable fasteners such that, in the disclosed example, each of the first and second parts 72*a* and 72*b* can be tensioned at the central coupler 70. In the disclosed example, each part 72*a* and 72*b* includes an inner end 75*a*, 75*b*, respectively, that is joined to the central coupler 70 using hex nuts 76 or other suitable fasteners. Each of the first and second parts 72*a* and 72*b* also includes an outer end 78*a* and 78*b*, respectively, with the outer ends 78*a* and 78*b* being attached to a corresponding one of the shoes 10 using for example, a pre-fixed terminal end 79 (FIG. 9 and FIG. 10A). Alternatively, the terminal end 79 may be either a nut or a threaded cross member or a fixed end similar to a barrel and wedge on a cable cross member. It will be appreciated when viewing FIG. 9 that the space 50 between the stanchion 24 and the retaining bracket 26 is large enough to accommodate the appropriate end of the cross member 72 and the exposed ends 68*a* and 68*b* of the inclined roof bolts 64*a* and 64*b* without interference between the cross member and the inclined bolt.

Figure 10B:
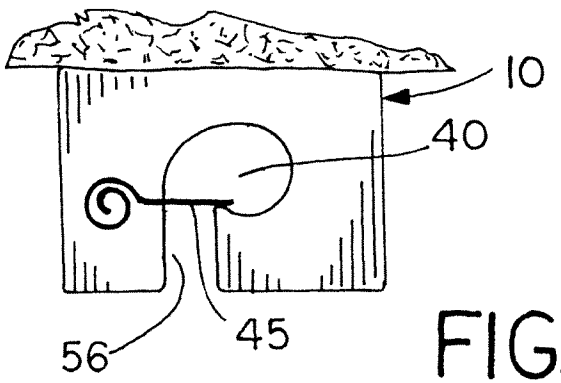
FIG. 10B is an end view similar to FIG. 10A but illustrating an optional spring clip disposed adjacent the J-shaped bore.
Figure 11:
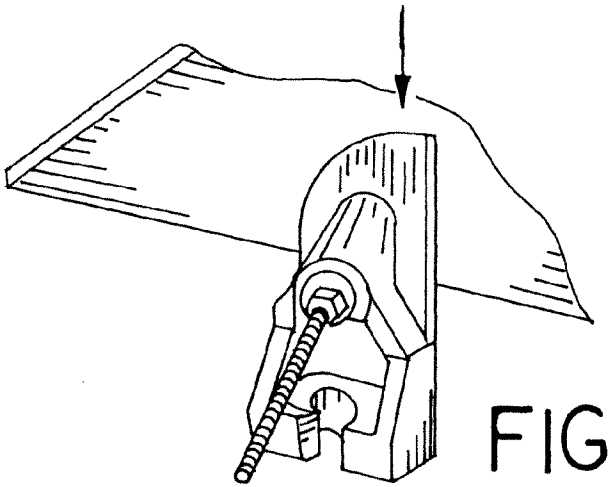
FIGS. 11-17 illustrate one manner of installing a truss shoe when forming a roof truss, and illustrating the truss shoe self-rotating between a first position (FIG. 11) and a second position (FIG. 17) in response to tensioning the inclined roof bolt.
Figure 12:
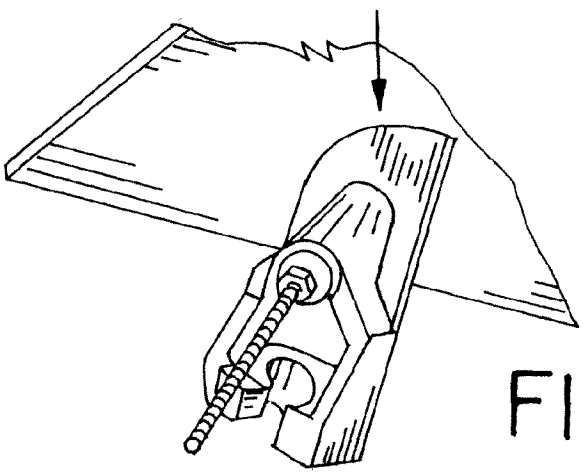
Figure 13:
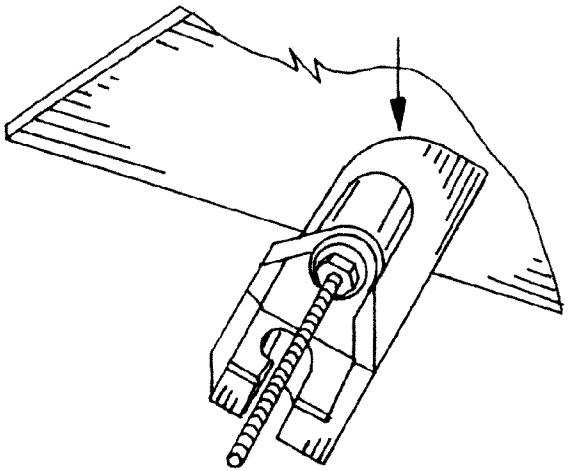
Figure 15:
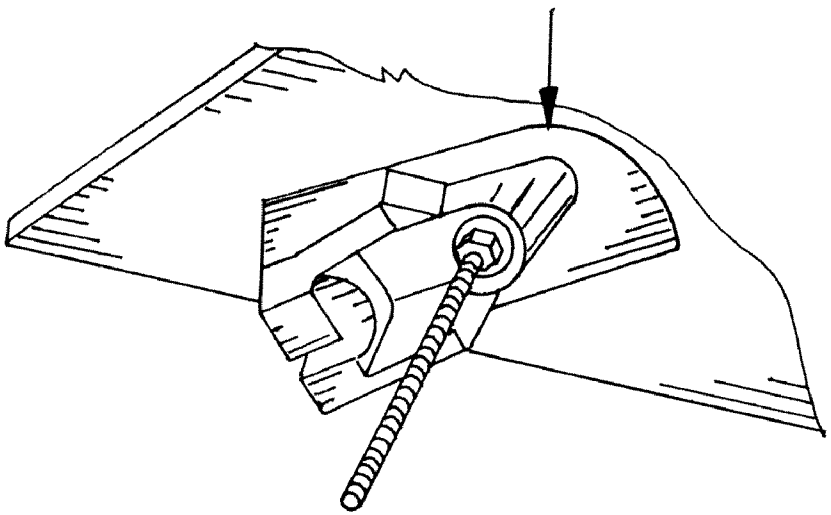
Figure 14:
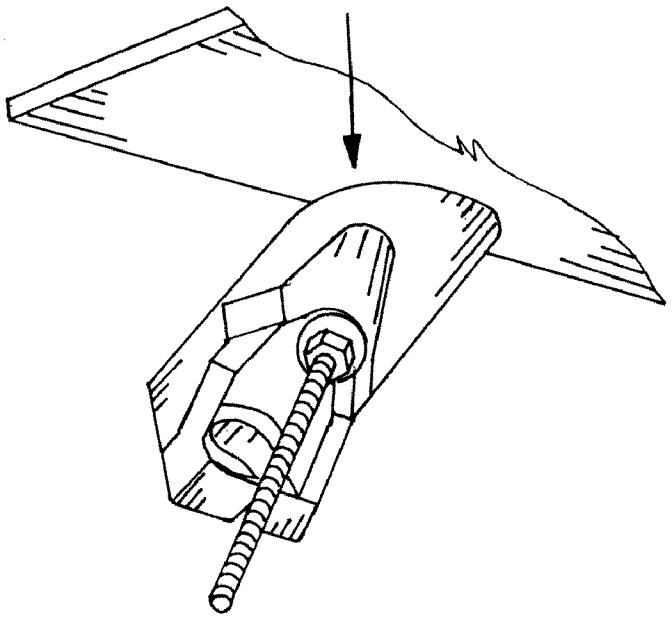

Referring now to FIG. 10A, the truss shoe 10 is shown with the bearing surface of the bottom side 14 facing upwardly and in contact with the roof 60 of the mine 62. The shank of the horizontal bolt 72 is shown disposed in the J-shaped bore 40. It will be understood that the horizontal bolt 72 may be placed into the bore 40 by manipulating the shank of the bolt 72 in a generally upward direction through the gap 56 defined by the opposed faces 54*a* and 54*b*. The shank of the bolt 72 will be retained as shown due to, at least in part, the presence of the retaining lip 44. The retention provision of the retaining lip 44 may be enhanced by providing a mounted spring clip 45 as shown in FIG. 10B The spring clip 45 opens in order to allow passage of the end of the cross member, and then closes to prohibit the cross member to slip back out of the J-slot 40. Thus the spring clip 45 serves as a gate. Accordingly, the a bolt 72 will stay positioned as shown regardless of whether the bolt 72 has been tensioned at the coupler 74 using the hex nuts 76.

Figure 17:
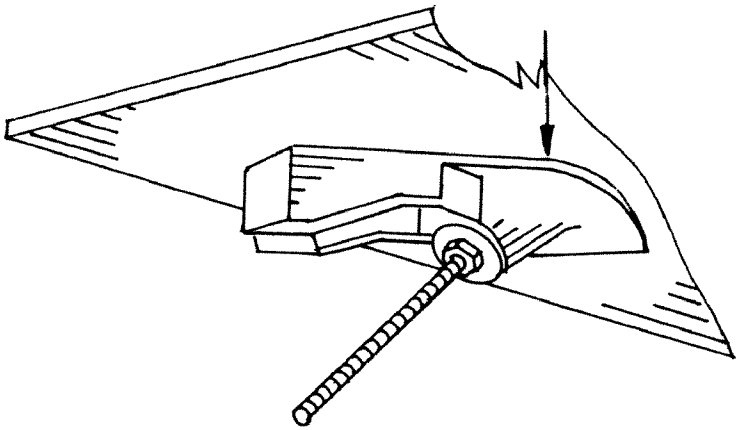
Figure 16:
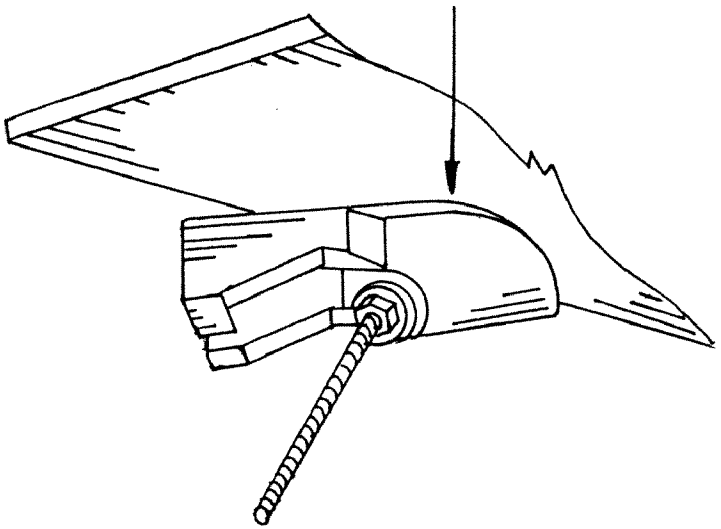

Referring now to FIGS. 11-17, one manner of installing the truss shoe 10 is shown. In a first position, the truss shoe 10 is positioned with the edge 16*a* on the end 16 in abutment with the mine roof 60 or in abutment with the mine roof 60. The exposed end 68*a* of the inclined roof bolt 64*a* is shown prior to tensioning the bolt 64*a* by tightening the hex nut 70. As the roof bolt 64*a* is inserted into the bore hole using, for example, right-hand rotation and thrust, the bolt is then tensioned using, by way of example rather than limitation, a conventional bolting machine (not shown). Thus, it will be appreciated that the truss shoe 10 will shift along the curved surface 23, aided, at least in part, by the chamfered edges 16*b*, 20*b* and/or 23*b*. Thus, the truss shoe 10 may shift and/or rotate gradually as the inclined roof bolt 64*a* is tensioned by rotating the nut 70, which permits the truss shoe 10 to end up as shown in FIG. 17 tightened against the mine roof, with the bearing surface on the bottom side 14 in abutment with the mine roof. The position of the truss shoe 10 as depicted in FIG. 17 is such that the installing mine operator does not have to directly manipulate the truss shoe 10 significantly before installing the cross member. It is understood, that the truss shoe 10 depicted with the curved edge 23 is designed for use with right-hand rotation during installation of the inclined bolt. For a left-hand installation the curved edge 23 would have to be mirror flipped on the truss shoe 10. Further, and with reference to FIG. 8, as the horizontal bolt 72 is tensioned, the truss shoe 10 is free to rotate slightly about a generally vertical axis C, such that, upon tensioning the horizontal bolt 72 as discussed above the truss shoe 10 will be brought into a desired position with the end 18 and the retaining bracket 26 disposed inwardly generally facing the central coupler 74. In all other respects, conventional and well excepted installation steps and procedures may be followed.

A mine roof truss assembled in accordance with teachings of the invention may thus comprise of a pair of spaced apart inclined bolts joined to a pair of ends of a tensionable cross member coupled at a central coupler to allow for tensioning. The inclined bolts may be installed with the truss shoe such that the shoe will self-rotate into a position suitable to connect the shoe to the cross member. The cross member may be connected to the truss shoe from a safe operator position by swinging the terminal end of the cross member through the J-shaped slot into a retained position in the truss shoe. The cross member may be retained therein by the lip formed in the J-slot and, optionally, by a spring clip attached to the truss shoe. The retention provision does not require tension in the cross member which significantly facilitates the installation of the truss as well as secures the cross member in the event the tension in the cross member drops during use of the truss.

Figure 18:
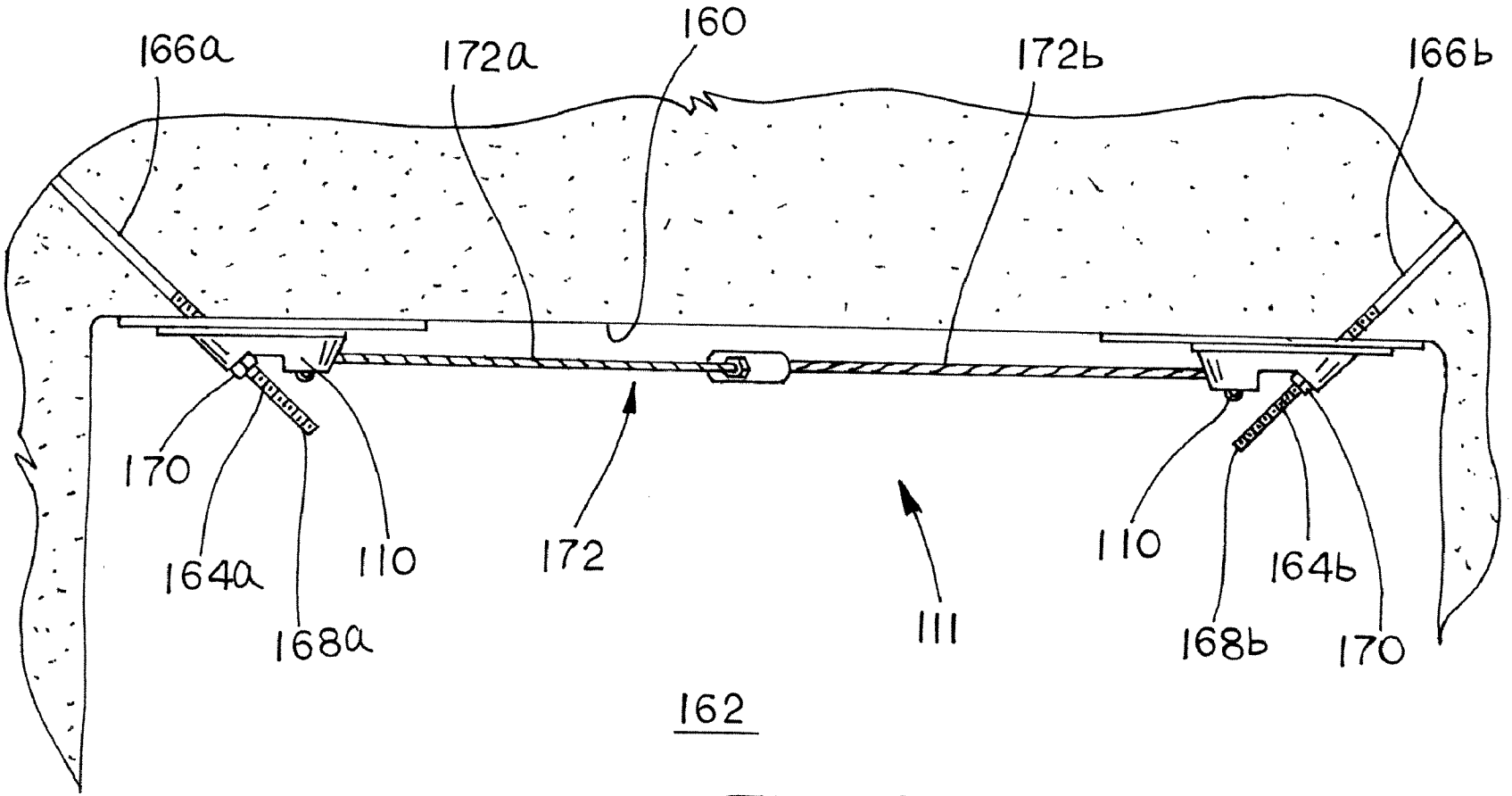
FIG. 18 is an elevation view, partly in cross section, of a truss system utilizing a truss shoe assembled in accordance with the teachings of the present invention and shown disposed in a mine passage.

Referring now to FIG. 18 of the drawings, a pair of truss shoes 110 assembled in accordance with the teachings of a second disclosed example of the present invention are shown, and are spaced apart generally adjacent a roof 160 of a mine 162 to form a roof truss 111. The construction and assembly of the roof truss 111 may be similar to the construction and assembly of the roof truss 11 discussed above with respect to the first disclosed example. Each of the truss shoes 110 is attached to a corresponding one of a pair of inclined roof bolts 164*a* and 164*b*. Again, each of the roof bolts may be a conventional roof bolt of the type commonly employed in the art, with each of the roof bolts 164*a*, 164*b* including an anchored portion 166*a*, 166*b*, respectively. The anchored portions 166*a*, 166*b* of each bolt 164*a*, 164*b* may be anchored to the surrounding rock (i.e. the roof 162) using cement, epoxy resin, a mechanical expansion shell, or any other suitable means of securement. Each of the bolts 164*a*, 164*b* also includes an exposed end 168*a*, 168*b*, with each exposed end having a suitable retaining nut 170. The cross member 172 again includes the first part 172*a* and the second part 172*b*, and extends between the spaced apart truss shoes 110, with the parts 172*a* and 172*b* again joined together by a central coupler 174, which may be conventional. Further, except as outlined below, the following embodiment(s) may be substantially similar to the above-described embodiment in all relevant respects. Further, the installation and assembly of the mine roof truss may be the same or similar as that described above with respect to the first disclosed embodiment.

Figure 19:
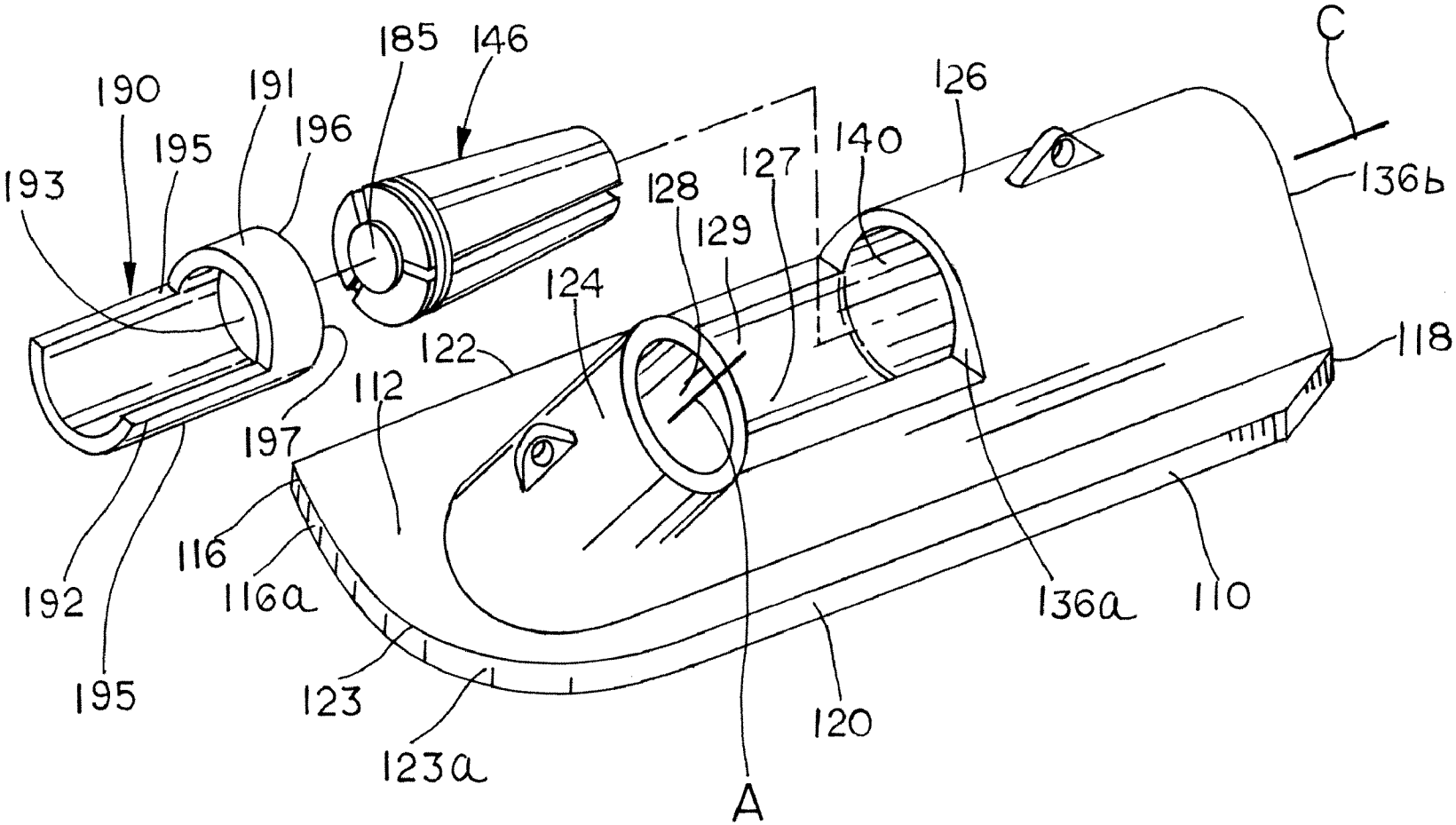
FIG. 19 is an isometric and partly exploded view of a truss shoe for a mine roof prior to receiving a cross member.
Figure 20:
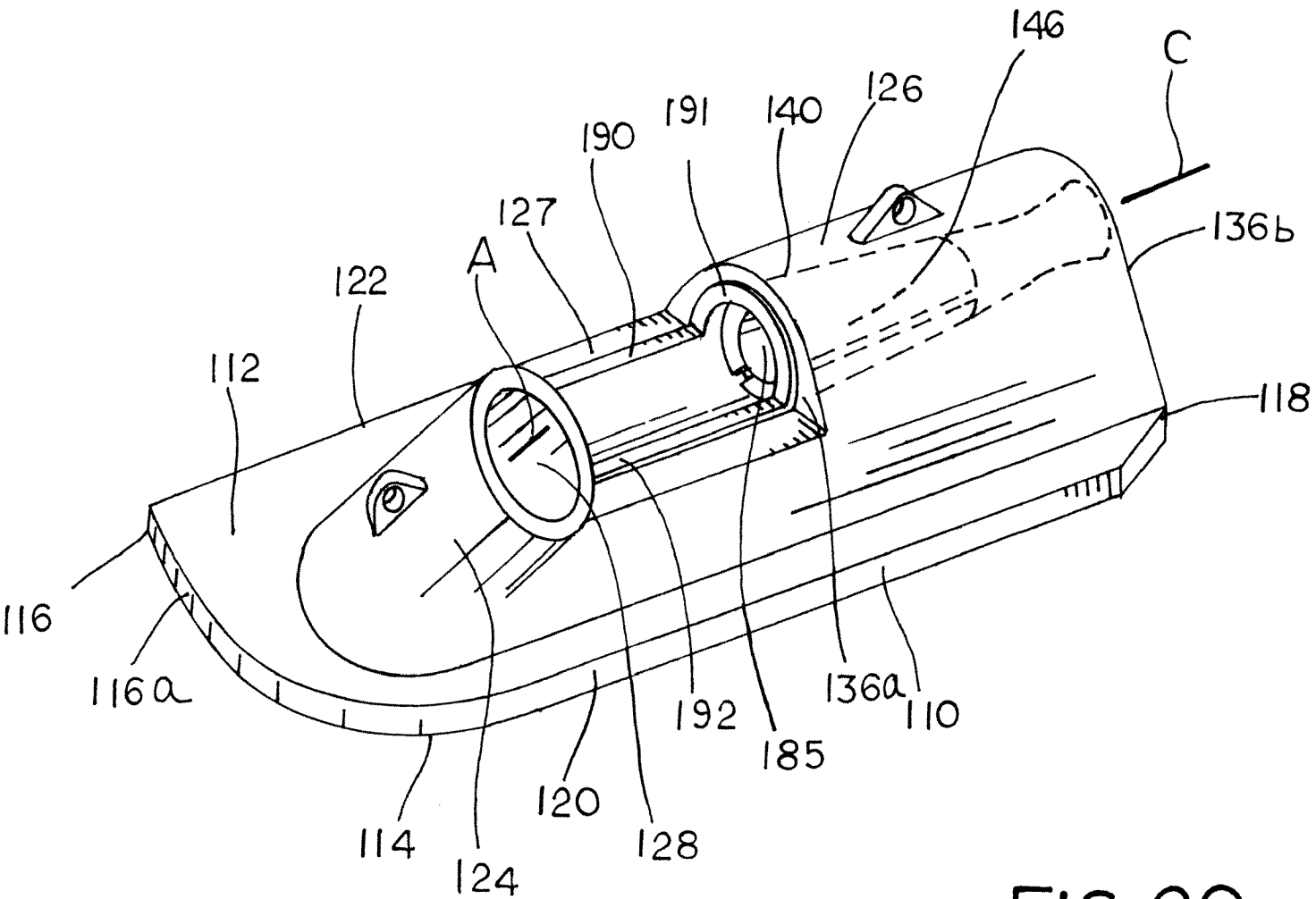
FIG. 20 is an isometric view similar to FIG. 19 and showing a retainer in place in a recess of the truss shoe.

Referring now to FIGS. 19 and 20, the truss shoe 110 includes a top side 112, a generally planar bottom side 114, a pair of ends 116, 118, and a pair of sides 120, 122. Again, for purposes of the following discussion, the terms "top" and "bottom" are used to refer to elements of the truss shoe 110 when the truss shoe 110 is disposed as shown in FIGS. 19 and 20, for example. It will be understood that when the truss shoe 110 is used in the mine roof truss 111, the bottom side 114 will face generally upward and will be in abutting contact with the roof of the mine. In the example of FIGS. 19 and 20, the end 116 and the side 120 may meet along a generally curved transition 123. Accordingly, the end 116 may includes a face or edge 116*a*, while the curved transition 123 may includes a face or edge 123*a*.

The truss shoe 110 includes a stanchion 124 and a housing 126, both formed on or otherwise attached to the top side 112 of the truss shoe 110. The stanchion 124 and the housing 126 are separated by a recess 127. In the example shown, the recess is generally semi-cylindrical in shape, with a surface 129 of the recess 127 generally conforming to the shape of a cylinder cut lengthwise. Other shapes for the recess may prove suitable. The stanchion 124 includes a bore 128, which extends through to the bottom side 114 along an axis A. Again, the stanchion 124 is preferably disposed at an angle relative to the generally planar bottom side 114. Therefore, the bore 128 also is disposed at an angle relative to the bottom side 114. The stanchion 124 and the bore 128 may be similar in all respects to the stanchion and bore described above with respect to the first disclosed embodiment, and are adapted to secure one of the inclined bolts 166*a* or 166*b* to the truss shoe 110 in a manner similar to that described above with respect to the first disclosed example.

The housing 126 includes a pair of ends 136*a*, 136*b*, and a bore 140 having an axis C extends between the ends 136*a* and 136*b*, such that the bore 140 extends through the housing 126. As can best be seen in FIGS. 21, 22 and 23, the bore 140 preferably includes a tapered portion 141, and is sized to receive one of the parts 172*a* (not shown in FIGS. 21-23) or 172*b* (shown in FIGS. 21-23) of the horizontal cross member 172, as well as a wedge assembly 146. The wedge assembly 146 may be placed in the bore 140, such that the wedge assembly 146 will engage a portion of a corresponding one of the parts 172*a* or 172*b* of the horizontal cross member 172. The bore 140 may also include a widened portion 143 toward the end 136*b* of the housing 126, which is adjacent the end 118 of the truss shoe 110.

As shown in FIG. 19, a retainer 190 includes a cylindrical portion 191 and a semi-cylindrical portion 192. The retainer 190 may be formed from a hollow cylinder having a through bore 193 and an outer surface 194. A notch 195 cut into the cylinder forms the cylindrical portion 191 and the semi-cylindrical portion 192. The bore 193 extends through an end 196 of the retainer 190, with the end 196 including a face 197.

Figure 27:
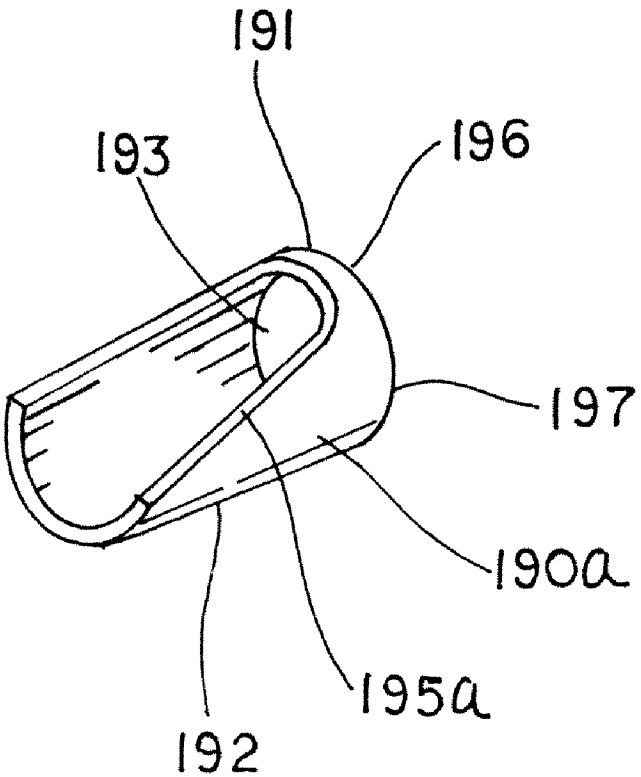
FIG. 27 is an enlarged isometric view of a retainer similar to the retainer shown in FIG. 19, but having a tapered or sloping cut instead of a notch.

Alternatively, as illustrated in FIG. 27, a retainer 190A may be used. As shown in FIG. 27, the retainer 190A also includes the cylindrical portion 191 and the semi-cylindrical portion 192, and again is formed from a hollow cylinder having the through bore 193 and the outer surface 194. However, instead of a notch, the retainer 190A has a sloping or tapered cut 195A. Once again, the bore 193 extends through the end 196 of the retainer 190A, with the end 196 including the face 197. The retainer 190A may be used in the same or similar manner as the retainer 190, and may be substituted for all the descriptions and/or use of the retainer 190.

Figure 21:
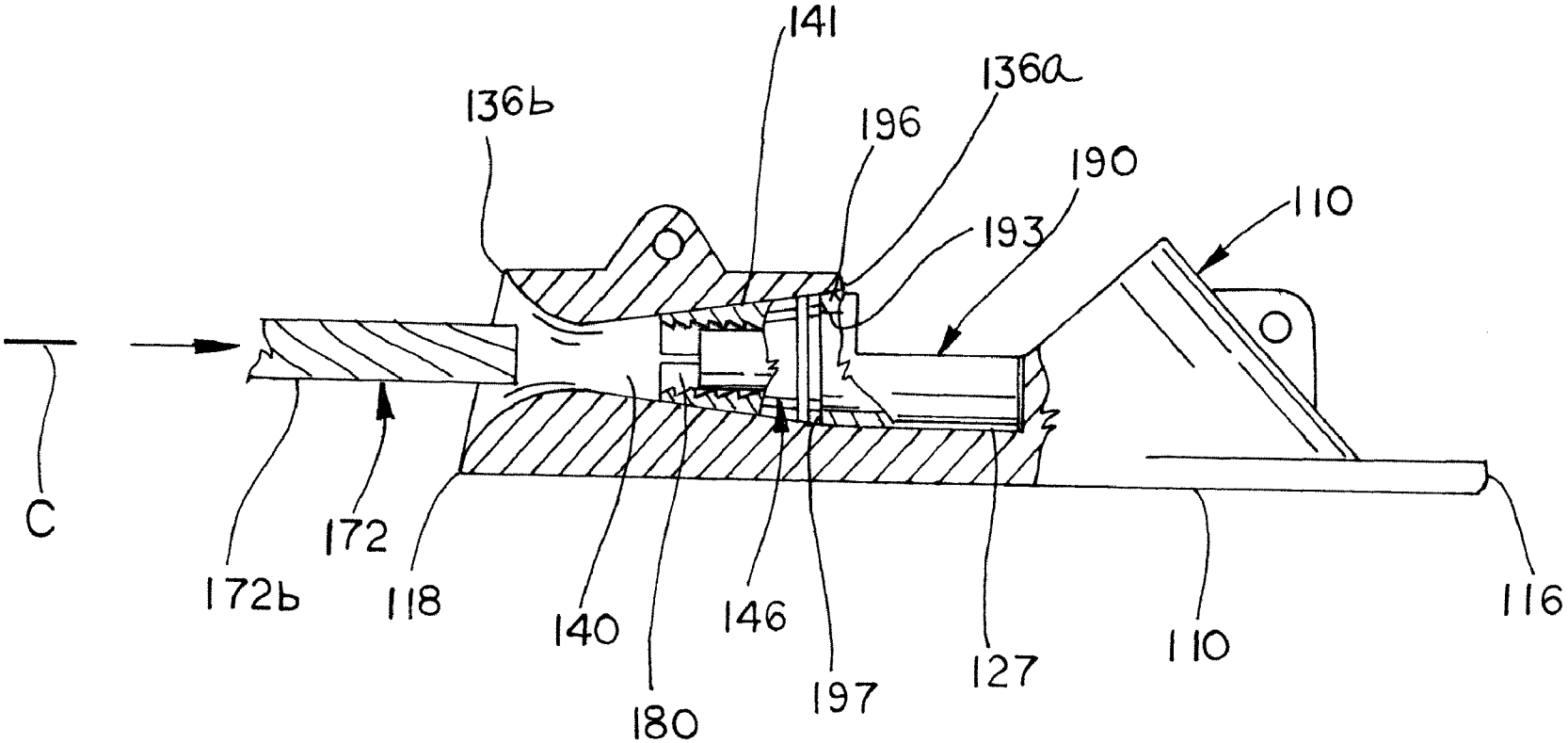
FIG. 21 is an enlarged cross-sectional view of the truss shoe shown in FIGS. 19 and 20 and showing a cable or cross member of the roof truss received by the truss shoe and about to abut a wedge plug.
Figure 22:
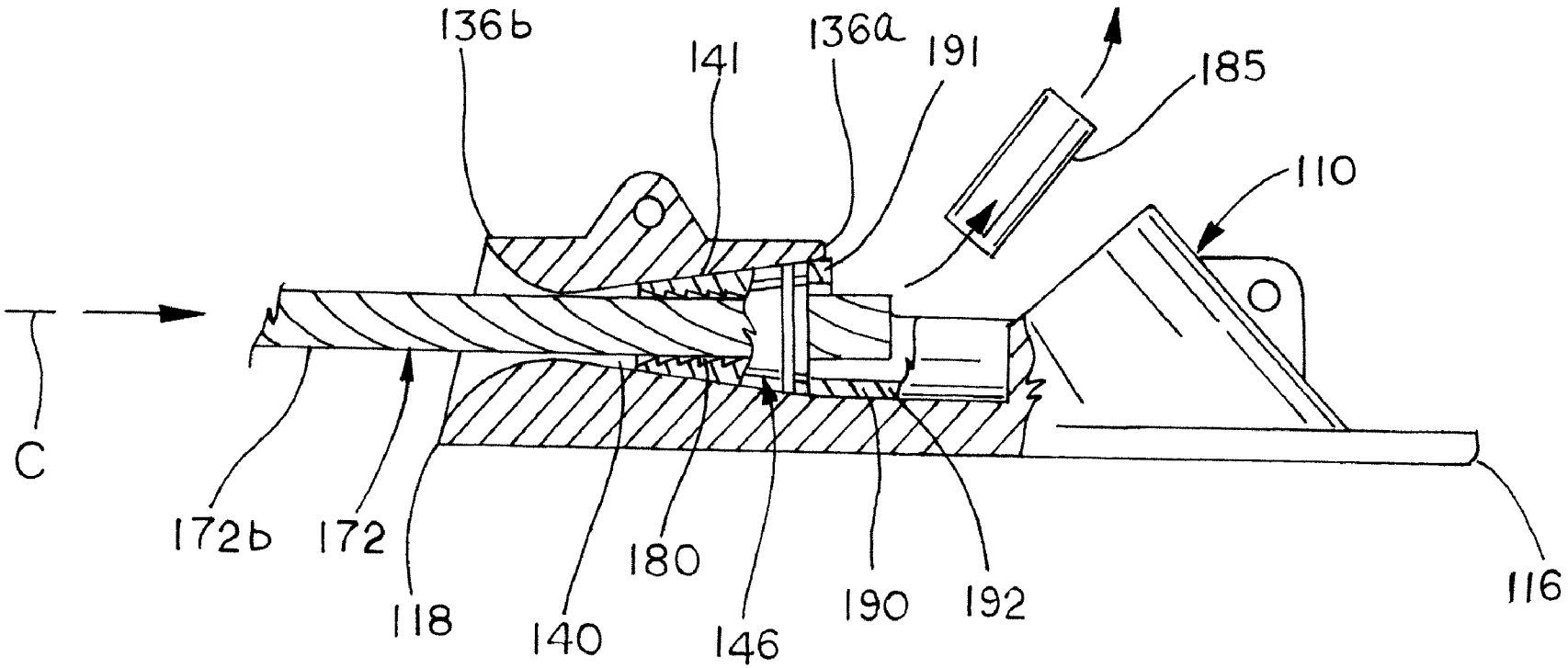
FIG. 22 is cross-sectional view similar to FIG. 21 and illustrating the cross member having dislodged the wedge plug in the truss shoe.
Figure 23:
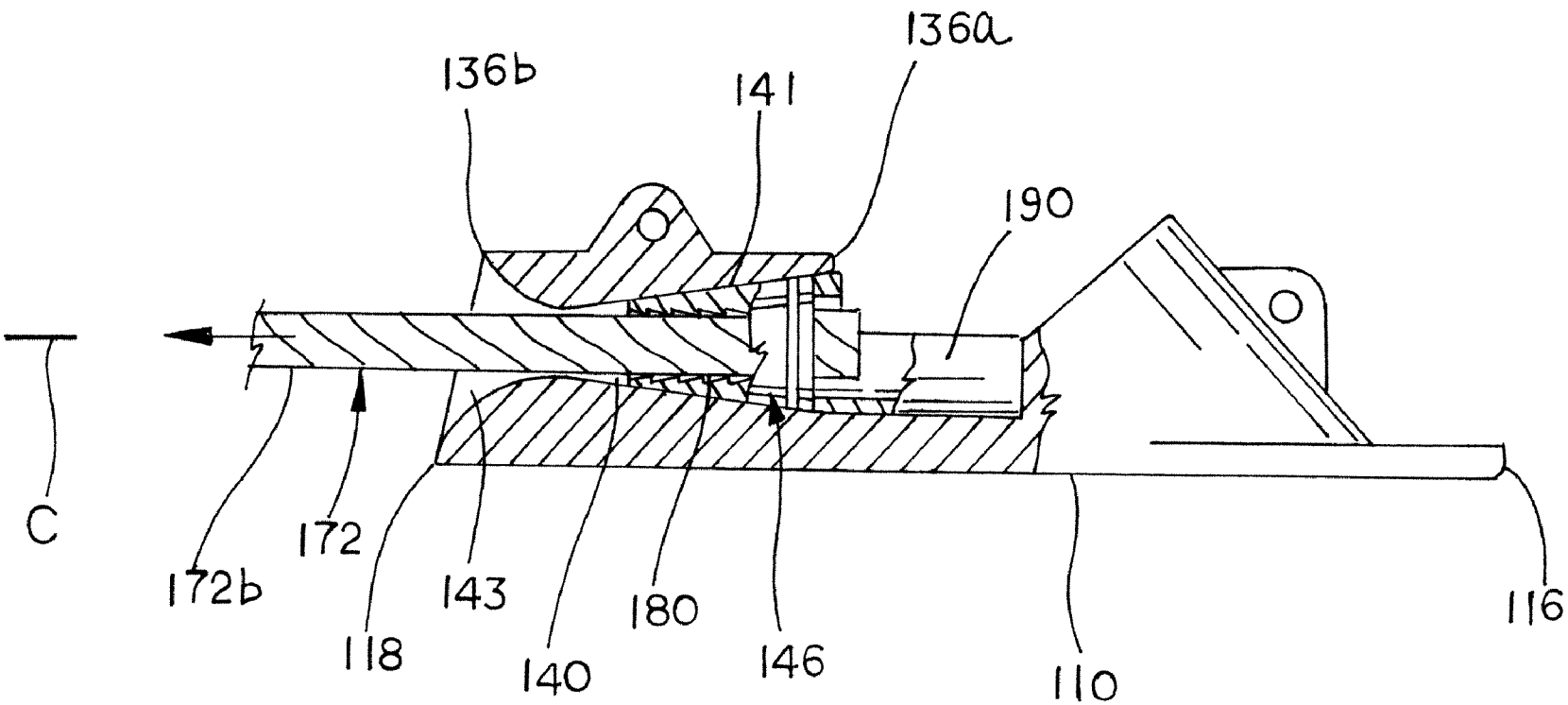
FIG. 23 is cross-sectional view similar to FIGS. 21 and 22 and illustrating the cross member in tension and gripped by a wedge assembly.

Referring now to FIGS. 21-23, the recess 127 and a bore 140 are shown in cross-section. The wedge assembly 146 is shown disposed in the tapered portion of the bore 140, and a plug 185 (discussed in greater detail below with respect to FIG. 24) is disposed inside the wedge assembly 146. The retainer 190 is disposed in the recess 127, with the end 196 of the retainer 190 extending adjacent to or partially into the bore 140. With the retainer 127 in the wedge assembly 146 positioned as shown, the face 197 of the retainer 190 prevents the individual wedge pieces 168*a*, 168*b*, and 168*c* (discussed in greater detail below with respect to FIG. 24) from exiting the bore 140 into the recess 127.

Referring now to FIG. 22, one part 172*b* of the crossmember 172 is shown being inserted into the bore 140 from the left when viewing the Figure. The end of the part 172*b* is sized to fit into a passageway 180 defined by the wedge assembly 146 and, when pushed to the right as shown in FIG. 22, the end of the part 172*b* pushes the plug 185 out from between the individual wedge pieces of the wedge assembly 146. The retainer 190 is sized such that the plug 185 may be dislodged from the truss shoe 110, and may be removed through or fall out of the open semi-cylindrical portion 192. The retainer 190 is also sized such that, although the plug 185 may pass through the retainer 190, the individual wedge pieces are prevented from exiting the bore 140 because the individual wedge pieces will be blocked by the face 197 of the retainer 190. In other words, the face 197, which is generally circular and surrounds the opening formed by the bore 193, partially obstructs a radially outward portion of the bore 193, thereby preventing the individual wedge pieces and/or the entire wedge assembly 146 from exiting the bore 193 into the recess 127. Consequently, as shown in FIG. 23, when tension is applied to the cable or part 172*b* toward the left when viewing FIG. 23, the individual wedge pieces of the wedge assembly 146 apply progressively greater force to the cable or part 172*b* as the wedge assembly 146 moves progressively deeper into the tapered portion 140 of the bore 140.

Figure 24:
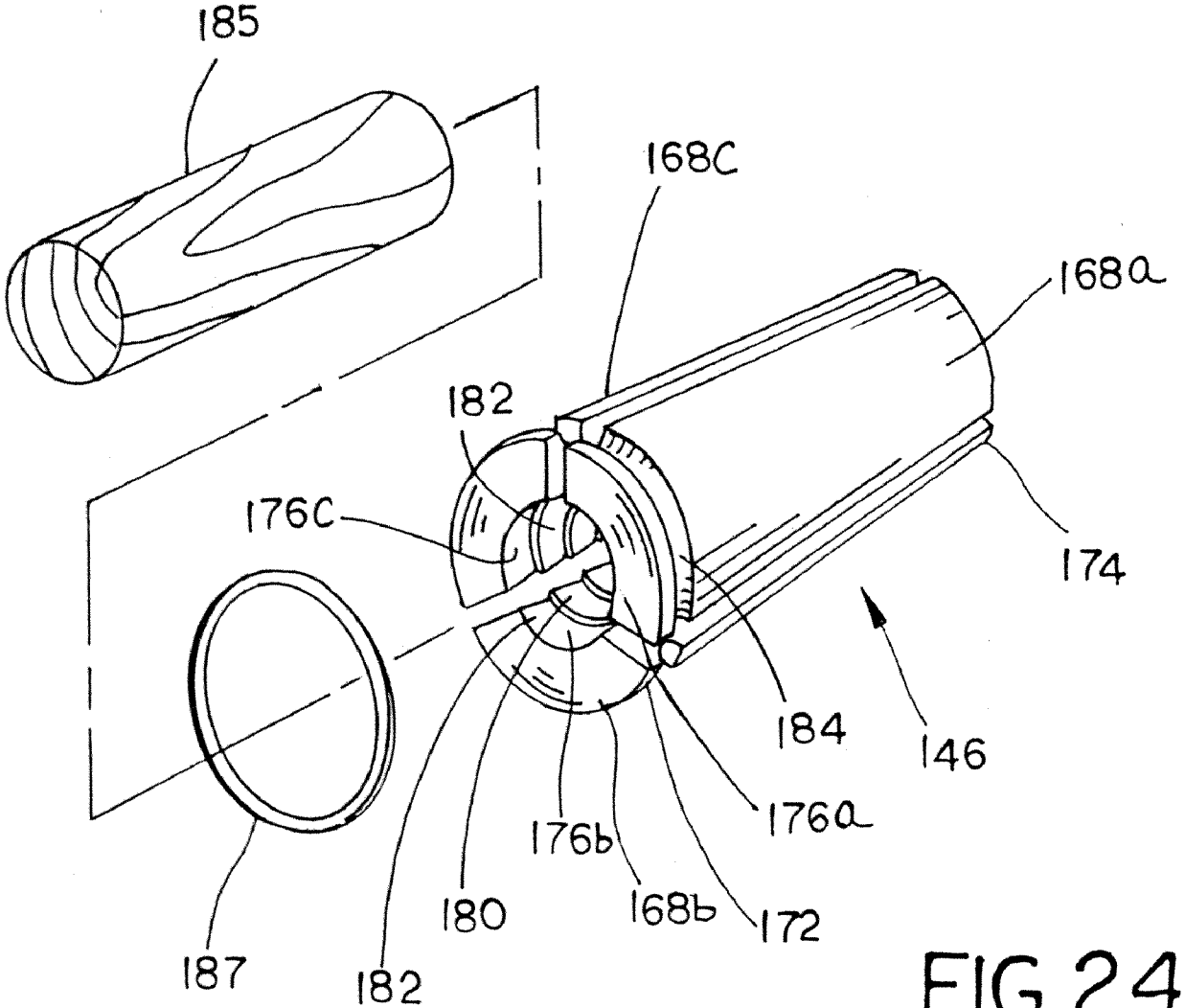
FIG. 24 is an enlarged isometric view of an exemplary wedge assembly.

As shown in FIG. 24, the wedge assembly 146 includes a number of individual wedge pieces. In the disclosed example, the wedge assembly 146 includes first, second, and third wedge pieces 168*a*, 168*b*, and 168*c*. Together, the pieces combine to substantially form a truncated cone with a base 172 and a tip 174. Two-piece wedge assemblies or other suitable wedge assemblies may also be employed.

Each of the wedge pieces 168*a*, 168*b* and 168*c* has an engaging face 176*a*, 176*b*, and 176*c*, such that when the wedge pieces 168*a*, 168*b* and 168*c* are assembled to form the wedge assembly 146, the engaging faces 176*a*, 176*b*, and 176*c* are in confronting relationship. Each of the wedge pieces 168*a*, 168*b* and 168*c* also include an internal cylindrical section 178*a*, 178*b*, and 178*c*. When the wedge pieces

168*a*, 168*b* and 168*c* are assembled to form the wedge assembly 146, the faces 176*a*, 176*b* and 176*c* form a generally circular passageway 180 within the wedge assembly 146. A set of teeth 182 are disposed on the faces 178*a*, 178*b*, and 178*c*. The teeth 182 may be formed in a known way such that an object in the passageway 180 may slide from the tip 174 of the wedge assembly 146 towards the base 172, but locked or resisted with respect to sliding from the base 172 toward the tip 174. A groove or recess 184 is disposed on the outside surface of each of the wedge pieces 168*a*, 168*b* and 168*c*, generally adjacent to the base 172. The groove 184 encircles the wedge assembly 146 at a generally constant distant from the base 172. A cylindrical plug 185, which may be a short dowel pin, is sized to be placed in the passageway 180. A resilient ring 187 is sized to be seated in the groove 184 of the wedge assembly 146. The ring 187 is preferably a resilient O-ring formed from, for example, rubber or other suitable material. The ring 187 can also be made from plastic or a suitable metal, and is preferably flexible to facilitate easy installation of the ring 187 into the groove 184 around the wedge assembly 146.

In the disclosed example, the plug 185 and the ring 187 cooperate to maintain the wedge pieces together as shown, for example, in FIG. 19. Additional details of the wedge assembly 146 and the individual wedge pieces can be found in co-pending U.S. patent application Ser. No. 11/224,492, filed Sep. 12, 2005, and entitled Cable Coupler Having Retained Wedges, the entire disclosure of which is incorporated by reference herein.

Figure 25:
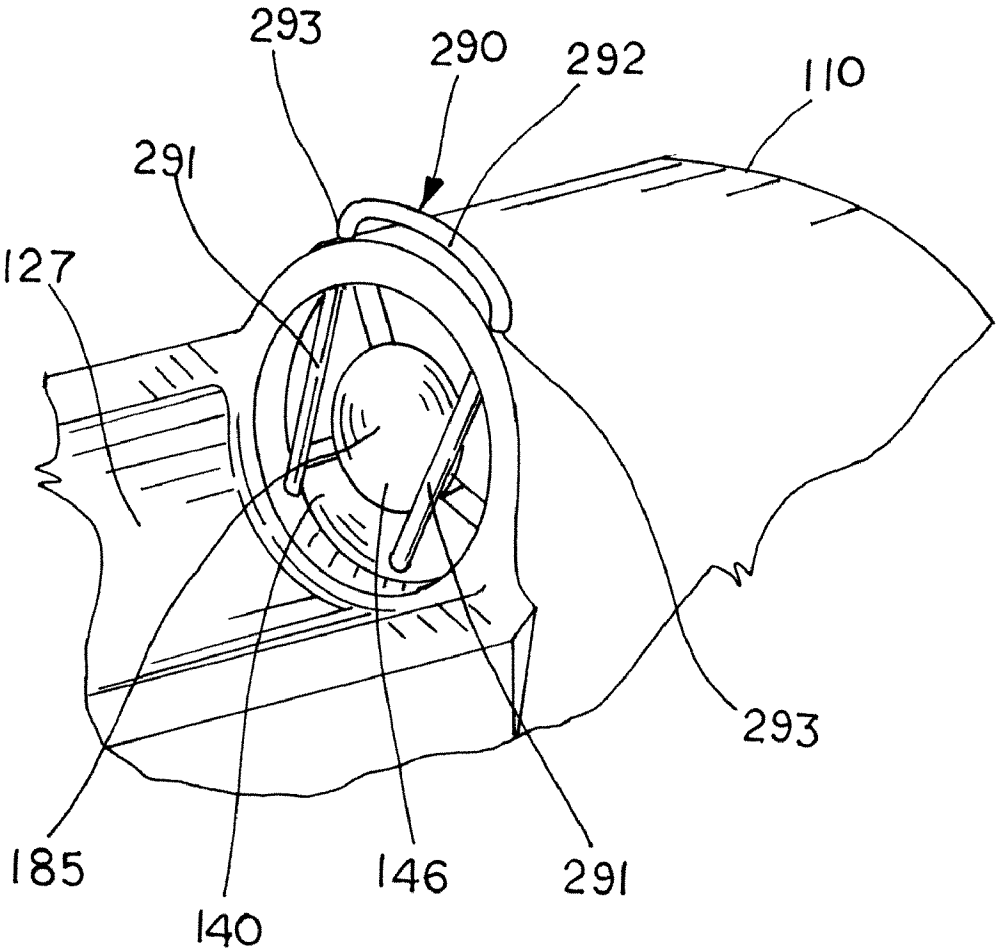
FIG. 25 is an enlarged fragmentary isometric view of the truss shoe of FIG. 19 and illustrating an alternate embodiment for the retainer.

Referring now to FIG. 25, another exemplary embodiment for the retainer is shown. Except for the items mentioned herein, for ease of reference the items mentioned above with respect to FIGS. 18-24 will retain their same reference numerals. In the example of FIG. 25, a retainer 290 takes the form of a U-shaped pin having a pair of prongs 291 and a crossmember 292. The housing 126 includes a pair of apertures 293 that extend into the bore 140. The spacing between the pins 291 is sufficient to permit the plug 185 to pass into the recess 127. However, as with the retainer 190 discussed above, the retainer 290 prevents the individual wedge pieces of the wedge assembly 146 from exiting the bore 140 into the recess 127. The remaining details of the truss shoe may be the same or similar to those details discussed above with respect to FIGS. 18-24.

Figure 26:
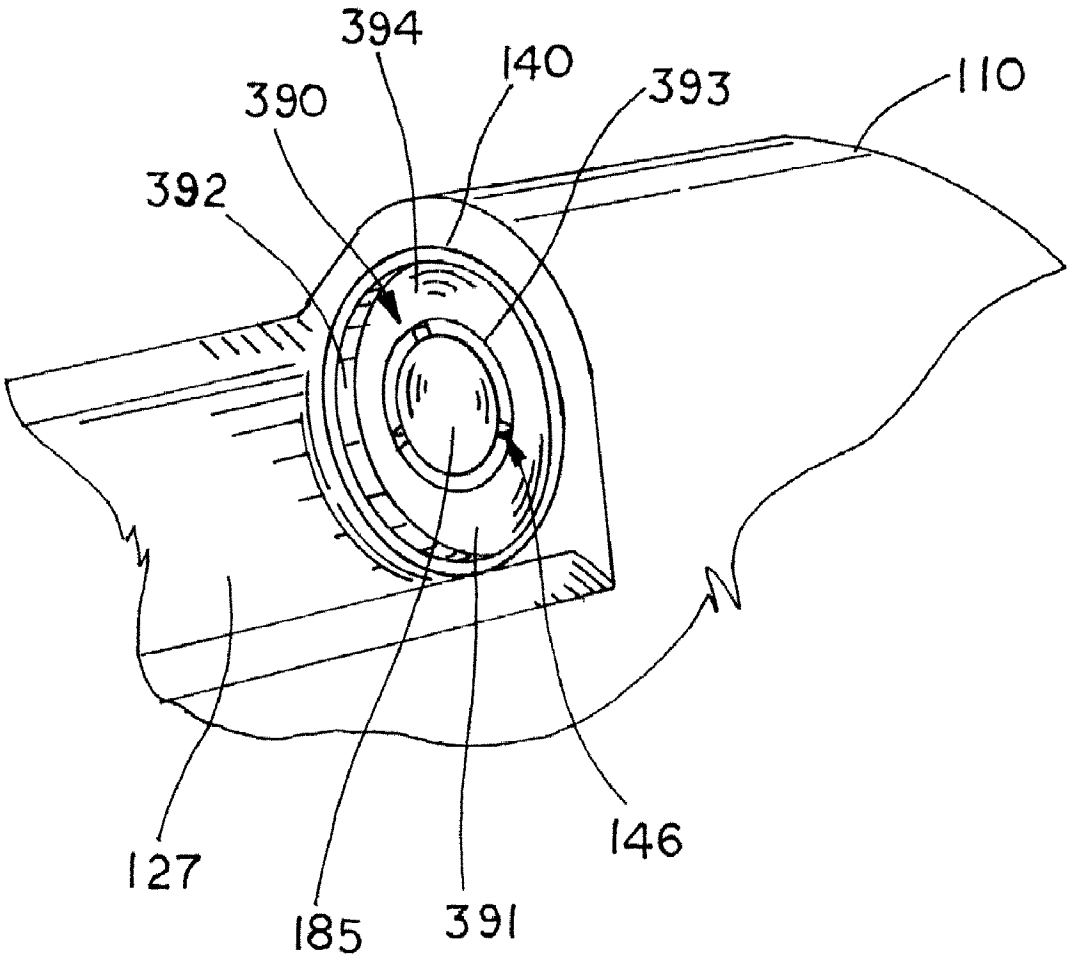
FIG. 26 is an enlarged fragmentary isometric view similar to FIG. 25 but illustrating yet another alternate embodiment for the retainer.

Referring now to FIG. 26, yet another exemplary embodiment for the retainer is shown. Once again, except for the items mentioned herein, for ease of reference the items mentioned above with respect to FIGS. 18-24 will retain their same reference numerals. In the example of FIG. 26, a retainer 390 takes the form of a disc 391 having an annular flange 392. The retainer 390 of FIG. 26 may generally resemble a bottle-top shape, and may include a central aperture 393 surrounded by an outer portion 394. As shown, the retainer 390 is disposed in the bore 140 of the truss shoe, such that the outer portion 394 blocks a portion of the bore 140. The central aperture 393 is preferably sized to permit the plug 185 of the wedge assembly 146 (both of which are discussed above in greater detail and are shown at least in FIG. 24) to pass through the aperture 393. When oriented as shown, the flange 392 extends outwardly away from the bore and toward the recess 127. Alternatively, the retainer 390 may be oriented so that the flange 392 extends inwardly into the bore 140. The retainer 390 may be constructed from a rigid material or from a deformable material, such as metal, certain plastics, etc. Other materials may prove suitable. As with the retainers 190 and 290 discussed above with respect to the previously-discussed examples, the retainer 390 is positioned to retain the individual wedge pieces of the wedge assembly 146 in the bore 140, while permitting the plug 185 to be dislodged in a manner similar to that shown in FIG. 22. The retainer 390 preferably is maintained in the bore 140 by an interference fit between the flange 392 and the inner surface of the bore 140.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A truss shoe for use in a roof truss adjacent a mine roof, the truss shoe comprising:

a base having a pair of ends, a curved side extending between the ends, a top side, and a bearing surface, the bearing surface adapted to abut the mine roof;

an angled stanchion on the top side having a first bore extending through to the bearing surface, the stanchion and the first bore adapted to receive an inclined bolt of the roof truss;

a housing on the top side, the housing separated from the stanchion by a recess, the housing including a second bore having a first opening adjacent an end of the housing and a having second opening disposed adjacent the recess;

the second bore including a tapered portion; and a retainer sized to fit in the recess, the retainer having an aperture disposed adjacent an end, the end of the retainer sized to block a portion of the second opening of the second bore; and wherein the retainer includes a cylindrical first portion and a semi-cylindrical second portion.

2. The truss shoe of claim 1 wherein the second bore houses a wedge assembly, the recess sized to permit the wedge assembly to be inserted into the second opening of the second bore through the recess, the wedge assembly having a plurality of wedges adapted to engage a cross member of the roof truss with progressively greater force in response to movement of the wedge assembly further into the tapered portion.

3. The truss shoe of claim 2, wherein the end of the retainer is arranged to prevent the plurality of wedges from exiting the second bore into the recess.

4. The truss shoe of claim 3, wherein the wedge assembly includes a removable spacer plug, and wherein the end aperture of the retainer is sized to permit the spacer plug to pass between the aperture and the recess while retaining the plurality of wedges in the second bore.

5. The truss shoe of claim 1, wherein the retainer is sized to extend at least partially into the second bore.

6. The truss shoe of claim 1, wherein the recess has a shaped lower surface, and wherein a lower surface of the retainer is shaped to engage the lower surface of the recess.

7. The truss shoe of claim 6, wherein the shaped lower surface and the lower surface of the retainer are semi-cylindrical.

8. The truss shoe of claim 1, wherein the first opening includes a widened end.

9. A truss shoe for use in a roof truss adjacent a mine roof, the truss shoe comprising:

a base having a pair of ends, a curved side extending between the ends, a top side, and a bearing surface, the bearing surface adapted to abut the mine roof;

an angled stanchion on the top side having a first bore extending through to the bearing surface, the stanchion and the first bore adapted to receive an inclined bolt of the roof truss;

a housing on the top side, the housing separated from the stanchion by a recess, the housing including a second bore having a first opening adjacent an end of the housing and a having second opening disposed adjacent the recess;

the second bore including a tapered portion; and a retainer sized to fit in the recess, the retainer having an aperture disposed adjacent an end, the end of the retainer sized to block a portion of the second opening of the second bore; and wherein the retainer is formed from a generally cylindrical tube and includes a notch.

10. A truss shoe for use in a roof truss adjacent a mine roof, the truss shoe comprising:

a base having a pair of ends, pair of sides extending between the ends, one of the pair of sides including a curved portion, a top side, and a bearing surface adapted to abut a mine roof;

an angled stanchion on the top side having a first bore extending through to the bearing surface, the stanchion and the first bore adapted to receive an inclined support of the roof truss;

the base including a second bore having a tapered portion, the second bore extending along an axis generally parallel to a plane of the bearing surface, the second bore having a first opening adjacent one of the ends of the housing and a having second opening disposed adjacent a recess;

a wedge assembly disposed in the tapered portion of the second bore, the recess sized to permit the wedge assembly to be inserted into the second bore through the second opening, the wedge assembly including a plurality of wedges adapted to engage a cross member of the roof truss with progressively greater force in response to movement of the wedge assembly further into the tapered portion; and a retainer disposed at least partially in the second bore and positioned to retain the plurality of wedges in the second bore and wherein the retainer is formed from a generally cylindrical tube and includes a notch.

11. The truss shoe of claim 10, wherein the retainer includes an end aperture and the wedge assembly includes a removable spacer plug, the end aperture of the retainer sized to permit the spacer plug to pass through the end aperture and into the recess while retaining the plurality of wedges in the second bore.

12. A truss shoe for use in a roof truss adjacent a mine roof, the truss shoe comprising:

a base having a pair of ends, pair of sides extending between the ends, one of the pair of sides including a curved portion, a top side, and a bearing surface adapted to abut a mine roof;

an angled stanchion on the top side having a first bore extending through to the bearing surface, the stanchion and the first bore adapted to receive an inclined support of the roof truss;

the base including a second bore having a tapered portion, the second bore extending along an axis generally parallel to a plane of the bearing surface, the second bore having a first opening adjacent one of the ends of the housing and a having second opening disposed adjacent a recess;

a wedge assembly disposed in the tapered portion of the second bore, the recess sized to permit the wedge assembly to be inserted into the second bore through the second opening, the wedge assembly including a plurality of wedges adapted to engage a cross member of the roof truss with progressively greater force in response to movement of the wedge assembly further into the tapered portion;

a retainer disposed at least partially in the second bore and positioned to retain the plurality of wedges in the second bore; and wherein the retainer comprises a pin insertable into the second bore.

13. The truss shoe of claim 12, including a pair of holes extending into the second bore, and wherein the pin comprises a u-shaped pin insertable into the holes.

* * * * *